US008549704B2

(12) United States Patent
Milligan et al.

(10) Patent No.: US 8,549,704 B2
(45) **Date of Patent: *Oct. 8, 2013**

(54) HAND-HELD CORDLESS VACUUM CLEANER

(75) Inventors: Michael A. Milligan, Gananoque (CA); Patrick W. Mooney, Brockville (CA); Xianyao Shen, Gloucester (CA); Ted A. Kimball, Oxford Station (CA); Andrew Walker, Newton Hall (GB)

(73) Assignee: Black & Decker Inc., Newark, DE (US)

( * ) Notice: Subject to any disclaimer, the term of this patent is extended or adjusted under 35 U.S.C. 154(b) by 361 days.

This patent is subject to a terminal disclaimer.

(21) Appl. No.: 12/907,472

(22) Filed: Oct. 19, 2010

(65) Prior Publication Data

US 2011/0030164 A1 Feb. 10, 2011

Related U.S. Application Data

(60) Continuation of application No. 12/371,043, filed on Feb. 13, 2009, now Pat. No. 7,845,046, which is a division of application No. 10/686,506, filed on Oct. 15, 2003, now abandoned.

(51) Int. Cl.
*A47L 9/10* (2006.01)

(52) U.S. Cl.
USPC ..... 15/352; 15/344; 15/327.2

(58) Field of Classification Search
USPC ..... 15/327.2, 344, 352
IPC ..... A47L 9/10,9/20
See application file for complete search history.

(56) References Cited

U.S. PATENT DOCUMENTS

| | | | |
|---|---|---|---|
| 156,288 | A | 8/1874 | Hughes |
| 971,044 | A | 9/1910 | Hutchinson |
| 1,156,235 | A | 10/1915 | Kirby |
| 1,420,665 | A | 6/1922 | Newcombe |
| 1,768,617 | A | 7/1930 | Lee |
| 2,036,789 | A | 4/1936 | Baker |
| 2,198,568 | A | 4/1940 | Yonkers, Jr. |
| 2,226,630 | A | 12/1940 | McCord |
| 2,242,278 | A | 5/1941 | Yonders, Jr. |
| 2,439,182 | A | 4/1948 | Nuffer et al. |
| 2,539,195 | A | 1/1951 | Lang |
| 2,564,468 | A | 4/1951 | Anderson |
| 2,935,158 | A | 5/1960 | Braun |
| 3,257,784 | A | 6/1966 | Grellsson |

(Continued)

FOREIGN PATENT DOCUMENTS

| | | |
|---|---|---|
| DE | 620 117 | 11/1935 |
| DE | 630 169 | 5/1936 |

(Continued)

*Primary Examiner* — David Redding
(74) *Attorney, Agent, or Firm* — John Yun

(57) ABSTRACT

A hand-held vacuum cleaner with a container for the storage of dirt and debris therein. To provide improved efficiency and performance, the hand-held vacuum may employ a primary HEPA filter, a device for swirling a dirt and debris laden air flow and/or a mechanized filter cleaning device. Swirling may be employed to direct entrained dirt and debris in a desired direction relative to the container to slow the rate with which dirt and debris accumulates on the primary filter and/or to centrifugally remove dirt and debris from the air flow. Mechanized cleaning is employed to shake, scrape or otherwise remove accumulated dirt and debris from the primary filter.

12 Claims, 27 Drawing Sheets

(56) References Cited

U.S. PATENT DOCUMENTS

| | | | |
|---|---|---|---|
| 3,296,781 | A | 1/1967 | Schumann |
| 3,339,350 | A | 9/1967 | Sims |
| 3,365,864 | A | 1/1968 | Iizima |
| 3,465,413 | A | 9/1969 | Rosaen et al. |
| 3,486,626 | A | 12/1969 | Miyagi et al. |
| 3,524,211 | A | 8/1970 | Wolf |
| 3,561,824 | A | 2/1971 | Homan |
| 3,731,465 | A | 5/1973 | Ohira et al. |
| D231,658 | S | 5/1974 | Stauft |
| 3,816,983 | A | 6/1974 | Sawada et al. |
| 3,841,067 | A | 10/1974 | Kato et al. |
| 3,856,488 | A | 12/1974 | Kato et al. |
| 3,861,381 | A | 1/1975 | Witman et al. |
| 3,898,129 | A | 8/1975 | Hawley |
| 3,898,414 | A | 8/1975 | Hawley |
| 3,898,488 | A | 8/1975 | Erwin et al. |
| 3,921,250 | A | 11/1975 | Jerabek |
| 4,007,026 | A | 2/1977 | Groh |
| D247,341 | S | 2/1978 | Pelly |
| 4,105,420 | A | 8/1978 | Moore |
| 4,209,875 | A | 7/1980 | Pugh et al. |
| 4,225,814 | A | 9/1980 | Gantz et al. |
| 4,248,613 | A | 2/1981 | Linhart |
| 4,304,580 | A | 12/1981 | Gehl et al. |
| 4,388,582 | A | 6/1983 | Saar et al. |
| 4,392,101 | A | 7/1983 | Saar et al. |
| 4,426,211 | A | 1/1984 | Ataka et al. |
| 4,533,370 | A | 8/1985 | Ikezaki et al. |
| 4,588,464 | A | 5/1986 | Miyagi et al. |
| 4,661,129 | A | 4/1987 | Nederman |
| 4,716,352 | A | 12/1987 | Hurn et al. |
| 4,745,654 | A | 5/1988 | Yamamoto et al. |
| 4,746,339 | A | 5/1988 | Millard |
| 4,790,306 | A | 12/1988 | Braun et al. |
| 4,821,366 | A | 4/1989 | Levine |
| RE33,074 | E | 10/1989 | Levine |
| 4,878,930 | A | 11/1989 | Manniso et al. |
| 4,920,606 | A | 5/1990 | Gerke, Jr. et al. |
| 4,920,608 | A | 5/1990 | Hult et al. |
| 4,934,020 | A | 6/1990 | Jackson |
| 4,947,514 | A | 8/1990 | Gerke, Jr. et al. |
| 4,967,443 | A | 11/1990 | Krasznai et al. |
| 1,786,384 | A | 12/1990 | Amstutz |
| 5,005,252 | A | 4/1991 | Steiner et al. |
| 5,011,058 | A | 4/1991 | Sapp et al. |
| 5,020,186 | A | 6/1991 | Lessig, III et al. |
| 5,020,187 | A | 6/1991 | Kosten et al. |
| 5,025,529 | A | 6/1991 | Hult et al. |
| 5,035,024 | A | 7/1991 | Steiner et al. |
| 5,043,640 | A | 8/1991 | Orton |
| 5,065,473 | A | 11/1991 | Krasznai et al. |
| 5,074,006 | A | 12/1991 | Eremita |
| 5,084,934 | A | 2/1992 | Lessig, III et al. |
| 5,092,015 | A | 3/1992 | Kosten et al. |
| 5,105,505 | A | 4/1992 | Reed, Jr. |
| 5,115,538 | A | 5/1992 | Cochran et al. |
| D327,342 | S | 6/1992 | Leung et al. |
| 5,134,751 | A | 8/1992 | Reed, Jr. et al. |
| 5,144,217 | A | 9/1992 | Gardner et al. |
| 5,148,094 | A | 9/1992 | Parks et al. |
| 5,199,963 | A | 4/1993 | Scarp |
| 5,297,311 | A | 3/1994 | Puri |
| 5,388,302 | A | 2/1995 | Sundaram et al. |
| D371,650 | S | 7/1996 | Dingelstad |
| 5,599,401 | A | 2/1997 | Brosky et al. |
| 5,611,831 | A | 3/1997 | Matsuoka et al. |
| 5,634,238 | A | 6/1997 | McCaffrey et al. |
| 5,664,285 | A | 9/1997 | Melito et al. |
| 5,699,586 | A | 12/1997 | Melito et al. |
| D389,963 | S | 1/1998 | Scanlon et al. |
| 5,733,351 | A | 3/1998 | Hult et al. |
| 5,787,546 | A | 8/1998 | Bass et al. |
| 5,795,358 | A | 8/1998 | Scanlon et al. |
| D403,416 | S | 12/1998 | Shelton et al. |
| 5,954,848 | A | 9/1999 | Otto et al. |
| 5,966,774 | A | 10/1999 | Bone et al. |
| 6,008,628 | A | 12/1999 | Brotto |
| 6,018,231 | A | 1/2000 | Shaver et al. |
| 6,075,341 | A | 6/2000 | White et al. |
| 6,110,248 | A | 8/2000 | Liu |
| 6,133,713 | A | 10/2000 | Brotto |
| 6,154,007 | A | 11/2000 | Shaver et al. |
| 6,154,008 | A | 11/2000 | Bradus et al. |
| 6,160,447 | A | 12/2000 | Huang |
| 6,172,487 | B1 | 1/2001 | Brotto |
| 6,192,550 | B1 * | 2/2001 | Hamada et al. ..... 15/352 |
| D443,004 | S | 5/2001 | Chan |
| 6,256,834 | B1 | 7/2001 | Meijer et al. |
| 6,269,518 | B1 | 8/2001 | Yung |
| D458,424 | S | 6/2002 | Chen |
| 6,434,785 | B1 | 8/2002 | Vandelbelt et al. |
| 6,462,513 | B1 | 10/2002 | Bradus et al. |
| 6,484,350 | B2 | 11/2002 | Yung |
| D472,683 | S | 4/2003 | Stratford |
| 6,546,592 | B1 | 4/2003 | Cockburn et al. |
| 7,845,046 | B2 * | 12/2010 | Milligan et al. ..... 15/352 |
| 2002/0069476 | A1 | 6/2002 | Yung |
| 2002/0166199 | A1 | 11/2002 | Boles et al. |
| 2003/0037403 | A1 | 2/2003 | Lang |

FOREIGN PATENT DOCUMENTS

| | | |
|---|---|---|
| DE | 1 768 312 | 6/1958 |
| DE | 1 874 119 | 6/1963 |
| DE | 1 959 657 | 3/1967 |
| DE | 1 988 318 | 6/1968 |
| DE | 1 403 128 | 11/1968 |
| DE | 68 13 511 | 12/1968 |
| DE | 1 403 131 | 2/1969 |
| DE | 1 607 730 | 9/1969 |
| DE | 1 964 261 | 7/1970 |
| DE | 1 611 157 | 10/1970 |
| DE | 1 951 306 | 11/1972 |
| DE | 33 09 162 | 9/1984 |
| DE | 33 25 336 | 1/1985 |
| DE | 85 06 818 | 8/1986 |
| DE | 86 23 695 | 11/1986 |
| DE | 86 29 781 | 4/1988 |
| DE | 37 27 980 | 3/1989 |
| DE | 90 12 439 | 12/1990 |
| DE | 42 35 745 | 4/1995 |
| DE | 37 43 083 | 8/1997 |
| DE | 196 53 570 | 9/1997 |
| DE | 298 14 547 | 1/1999 |
| DE | 197 33 680 | 2/1999 |
| DE | 199 03 734 | 8/2000 |
| DE | 199 25 277 | 7/2001 |
| DE | 199 59 513 | 7/2001 |
| DE | 101 10 582 | 1/2002 |
| DE | 100 56 935 | 2/2002 |
| EP | 0 008 117 | 11/1985 |
| EP | 0 170 720 | 2/1986 |
| EP | 0 160 168 | 5/1989 |
| EP | 0 116 870 | 4/1990 |
| EP | 0 215 165 | 7/1991 |
| EP | 0 468 200 | 8/1993 |
| EP | 0 444 516 | 11/1994 |
| EP | 0 548 523 | 7/1995 |
| EP | 0 674 870 | 10/1995 |
| EP | 0 914 795 | 5/1999 |
| EP | 0 983 743 | 3/2000 |
| EP | 1023864 | 8/2000 |
| EP | 0 921 748 | 10/2000 |
| EP | 1 070 478 | 1/2001 |
| EP | 0 749 719 | 4/2001 |
| EP | 0 647 114 | 11/2001 |
| EP | 1 161 915 | 12/2001 |
| FR | 1094603 | 5/1955 |
| WO | WO 01/80704 | 11/2001 |
| WO | WO0238025 | 5/2002 |

* cited by examiner

HAND-HELD CORDLESS VACUUM CLEANER

CROSS-REFERENCE TO RELATED APPLICATIONS

The present application is a continuation of U.S. application Ser. No. 12/371,043, filed Feb. 13, 2009, allowed, which is a divisional of U.S. application Ser. No. 10/686,506, filed Oct. 15, 2003, now abandoned.

INTRODUCTION

The present invention generally relates to hand-held portable vacuum cleaners and improvements thereto.

Typically, hand-held portable vacuum cleaners employ a motor that is powered by either a main supply of electricity (i.e., a source of alternating current power) or a battery pack, which may be rechargeable, to drive an impeller. Rotation of the impeller generates an air flow which entrains therein dirt and debris which enter the vacuum cleaner via an inlet. One or more filters may be employed to retain the dirt and debris within the vacuum.

One problem with such vacuum cleaners concerns the relatively rapid rate with which the efficiency and performance of such vacuum cleaners may deteriorate. Specifically, the use of such vacuums to collect relatively small sized particles can rapidly load the filter and substantially reduce the amount of air that passes therethrough. When filter loading is encountered in the known hand vacuum configurations, the user must disassemble the vacuum, remove the filter, clean (or dispose of and replace) the filter and replace the filter. In some situations, the user may be reluctant to perform the tasks of removing and cleaning the filter due to the unwholesomeness of the material that has accumulated on the filter. In situations where the filter is heavily loaded, the vacuum will have a relatively low efficiency and consequently, vacuuming tasks will take longer, the vacuum will experience greater wear, and if battery powered, the user will be able to perform relatively fewer vacuuming tasks per charge.

SUMMARY OF THE INVENTION

In one form, the present teachings provide a hand-held portable vacuum having a housing, an impeller that is at least partially disposed in the housing, a dirt cup and a HEPA filter. The dirt cup, which is removably attached to the housing, includes an inlet and defines a container for storage of dirt and debris therein. The HEPA filter is disposed between the impeller and the inlet.

In another form, the present teachings provide provides a method for filtering a dirt and debris laden air flow. The method includes: providing a hand-held vacuum with a housing, an impeller, an inlet, a container and a primary filter, the housing including a handle that permits a user to employ the hand-held vacuum for vacuuming with a single hand, the impeller being disposed within the housing, the inlet being configured to receive the dirt and debris laden air flow therethrough, the container being configured to retain dirt and debris removed from the dirt and debris laden air flow and the primary filter being disposed between the impeller and the inlet; rotating the impeller to generate the dirt and debris laden air flow; and swirling the dirt and debris laden air flow about the interior of the container.

In yet another form, the present teachings provide a hand-held portable vacuum including a housing with a handle, a dirt cup, an impeller at least partially disposed in the housing, a filter and a filter cleaning device. The dirt cup, which is removably attached to the housing, has an inlet and defines a container for storage of dirt and debris therein. The filter, which is disposed between the impeller and the inlet, is formed with a plurality of pleats. The filter cleaning device is coupled to at least one of the housing and the dirt cup and includes at least one rib and a hub. The hub is coupled to one of the filter and the rib and configured to rotate the one of the filter and the rib about the other one of the filter to generate contact between the rib and the filter to at least partially dislodge accumulated dirt and debris from the pleats.

In a further form, the present teachings provide a hand-held portable vacuum including a housing with a handle, a dirt cup, an impeller, a filter and a means for swirling the dirt and debris laden air in the dirt cup. The dirt cup, which is removably attached to the housing, has an inlet and defining a container for storage of dirt and debris therein. The impeller is at least partially disposed in the housing and operable for generating an air flow that flows through the inlet. The filter is disposed between the impeller and the inlet.

Further areas of applicability of the present teachings will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DESCRIPTION OF VARIOUS EMBODIMENTS

Figure 1:
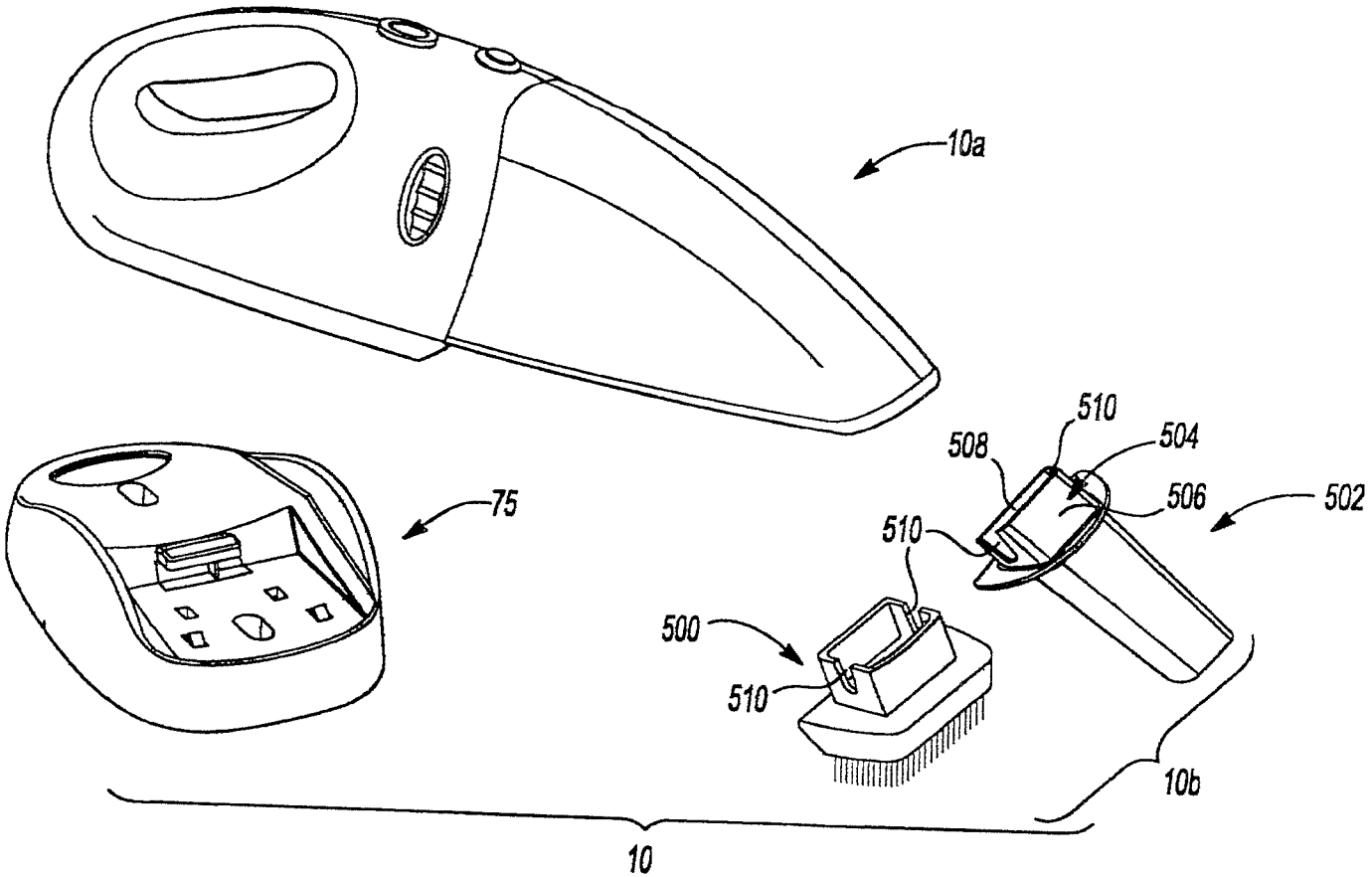
FIG. 1 is a perspective view of a vacuum kit constructed in accordance with the teachings of the present invention.
Figure 2:
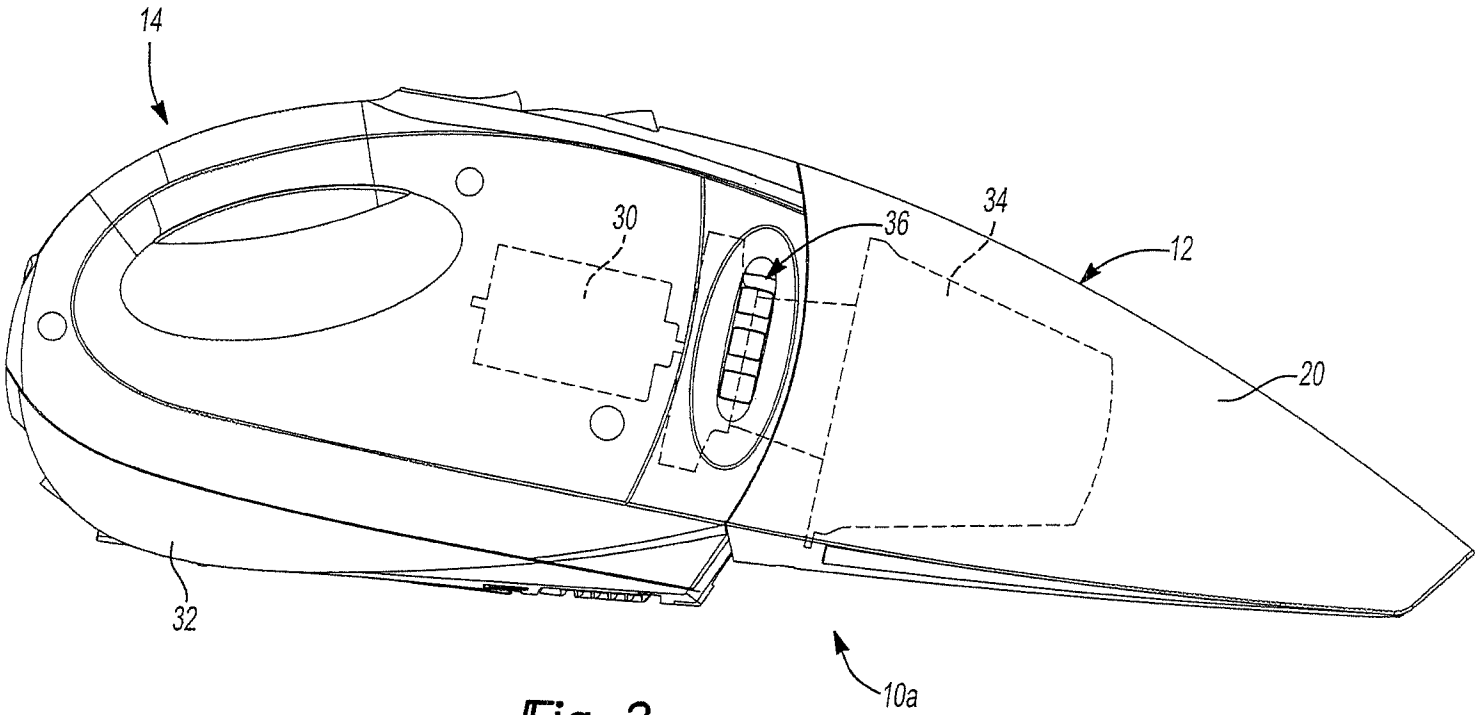
FIG. 2 is a side elevation view of a portion of the vacuum kit of FIG. 1 illustrating the vacuum in greater detail.
Figure 3:
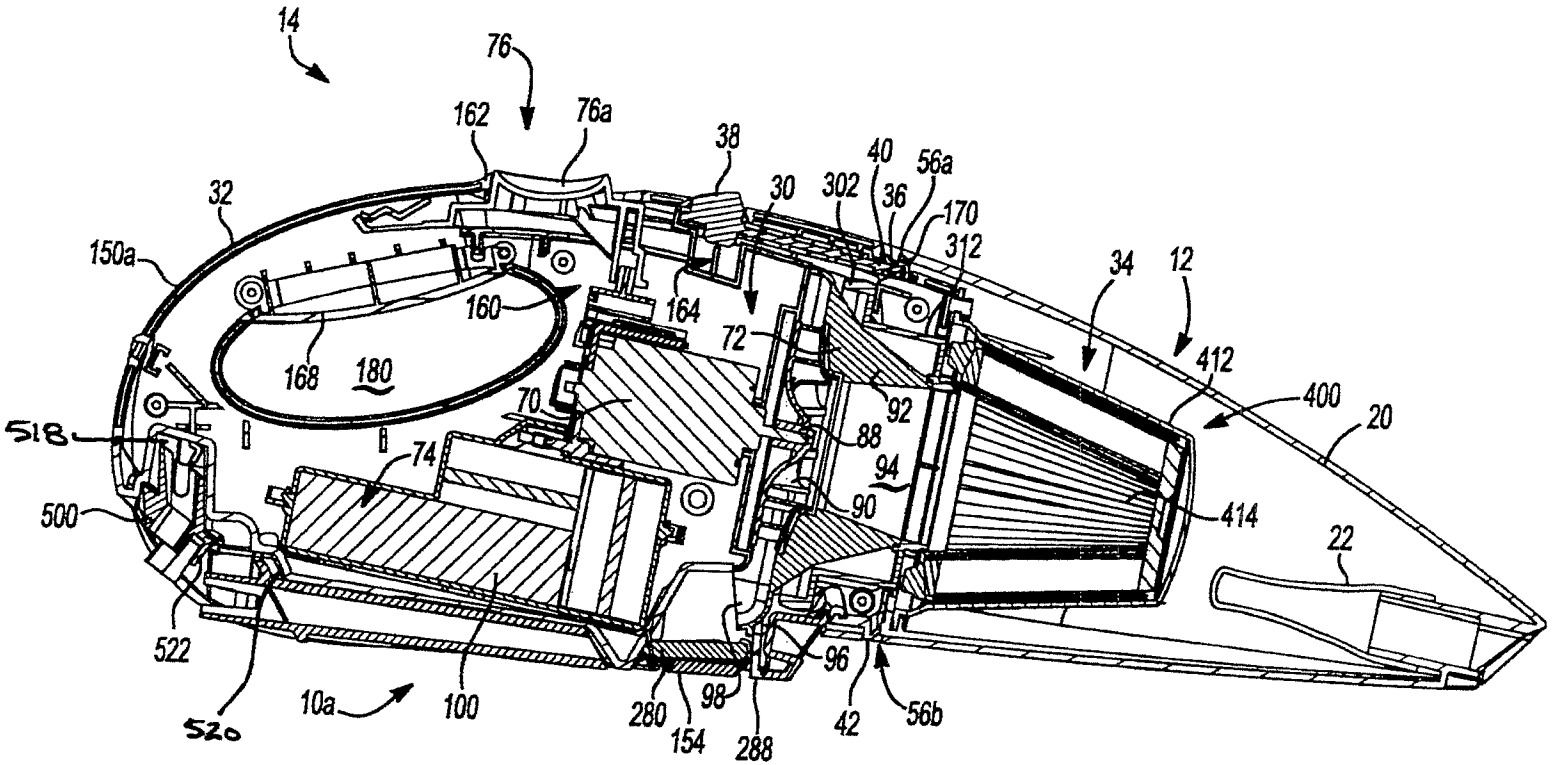
FIG. 3 is a longitudinal section view of the vacuum of FIG. 2.

With reference to FIG. 1 of the drawings, a vacuum kit constructed in accordance with the teachings of the present invention is generally indicated by reference numeral 10. The vacuum kit 10 may include a hand-held cordless vacuum 10*a* and an optional set of accessories 10*b*. With reference to FIGS. 2 and 3, the vacuum 10*a* may include a dirt cup assembly 12 and a housing assembly 14. In the particular example provided, the dirt cup assembly 12 includes an inlet housing or dirt cup 20 and an elbow 22, while the housing assembly 14 may include motor assembly 30, an outlet housing or housing 32, a filter system 34, a filter cleaning system 36 and a latch release 38 having a conventional latch mechanism 40 and a conventional retaining tab 42 that may be integrally formed with the housing 32.

Figure 4:
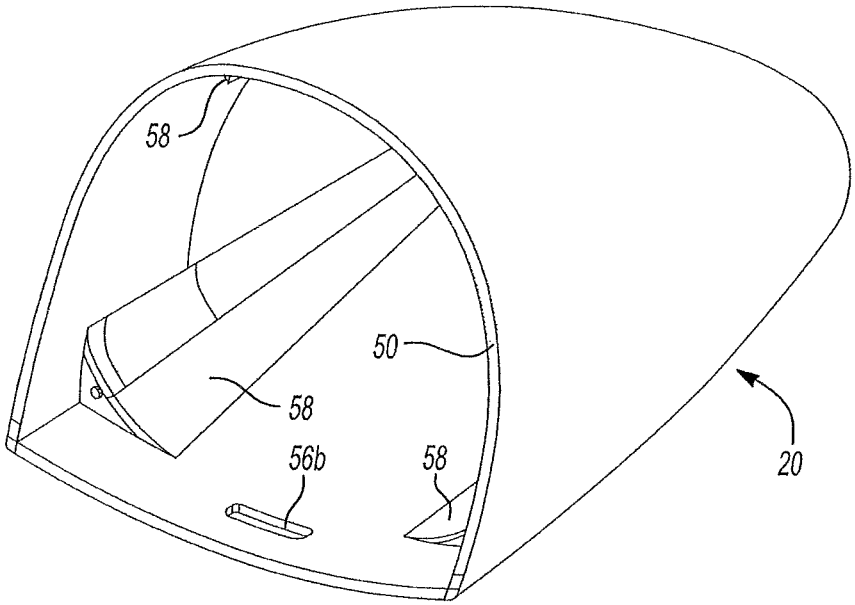
FIG. 4 is a perspective view of a portion of the vacuum of FIG. 2 illustrating the dirt cup in greater detail.
Figure 5:
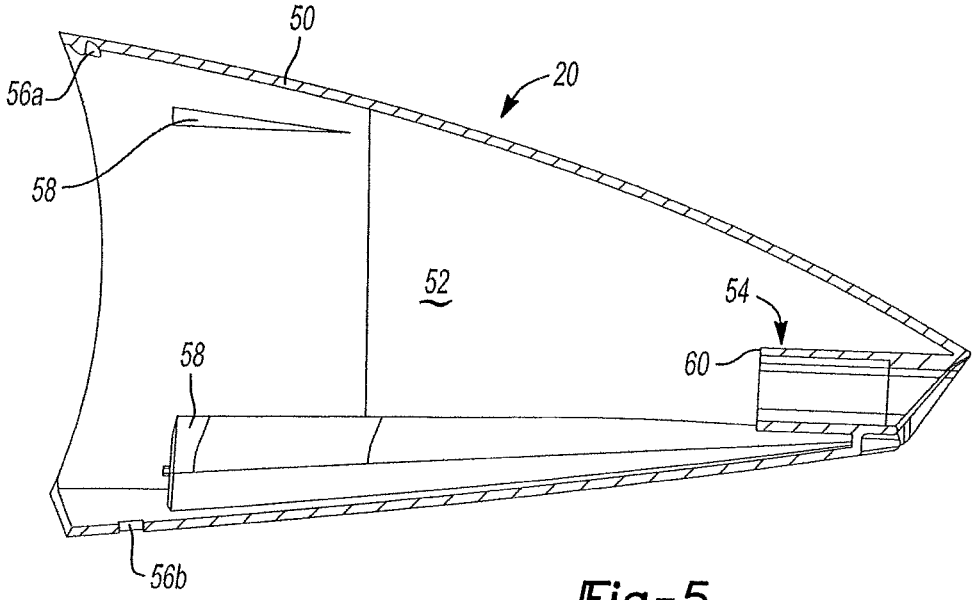
FIG. 5 is a longitudinal section view of the dirt cup of FIG. 4.

In FIGS. 4 and 5, the dirt cup 20 includes a wall member 50 that defines a container-like housing structure 52 and an inlet port 54 that may be formed through the housing structure 52 and which may extend rearwardly therefrom. A pair of securing apertures 56*a* and 56*b* may be formed in and through the housing structure 52, respectively, and a plurality of prefilter locating tabs 58 may extend inwardly from the wall member 50 about the inside perimeter of the housing structure 52. Both the securing apertures 56*a* and 56*b* and the prefilter locating tabs 58 will be discussed in additional detail, below.

Figure 6:
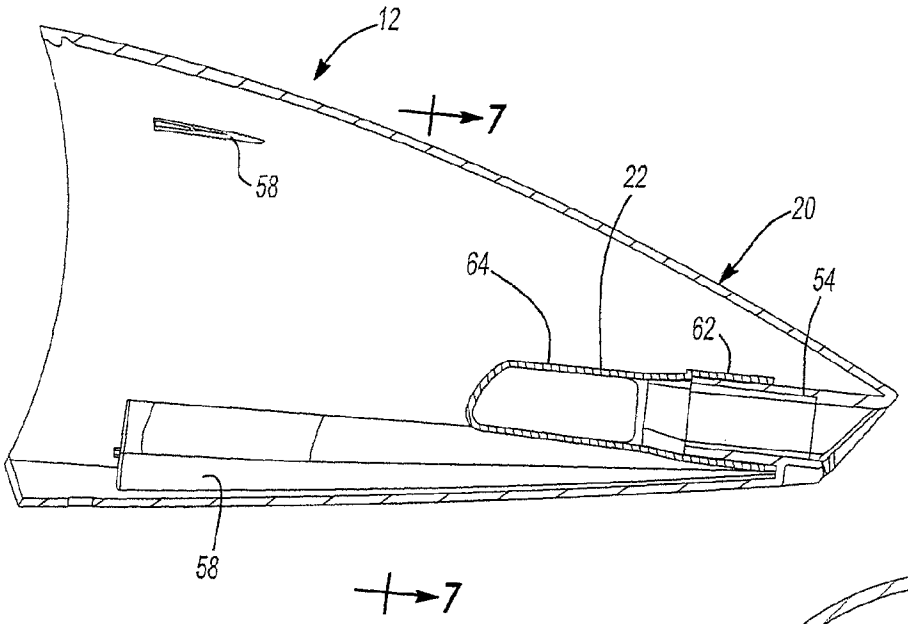
FIG. 6 is a longitudinal section view of a portion of the vacuum of FIG. 2 illustrating the dirt cup assembly in greater detail.
Figure 7:
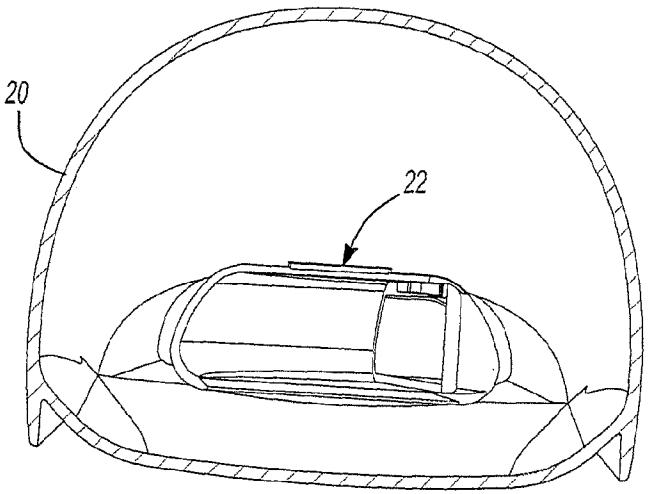
FIG. 7 is a sectional view taken along the line 7-7 of FIG. 6.

The inlet port 54 may have a generally rectangular cross-sectional shape that extends rearwardly from the housing structure 52 and terminates at a rearward face 60. As will be discussed in greater detail, below, the front end of the inlet port 54 may be configured to frictionally engage various components of the accessory set 10*b* (FIG. 1), while the rear end of the inlet port 54 may be configured to frictionally engage the elbow 22, which is shown in FIG. 6.

With reference to FIGS. 6 through 9, the elbow 22 may include an attachment portion 62 that may be sized to frictionally but removably engage the rear end of the inlet port 54 and a body portion 64 that turns the incoming air flow in a desired manner as will be discussed in greater detail, below. The body portion 64 may be sized so as not to choke or diffuse the air flow that is provided through the inlet port 54. The interior of the dirt cup 20 (i.e., a cross section taken perpendicular to the longitudinal axis of the dirt cup 20) may be smooth and at least somewhat circular in shape (i.e., lacking sharp corners—see, FIG. 7) so as to promote the swirling of the inlet air flow about the longitudinal axis of the dirt cup 20.

In FIG. 3, the motor assembly 30 may include a motor 70, a fan assembly 72, a battery pack 74 and a power switch 76. The motor 70 may be a conventional DC motor having a motor output shaft 88. The fan assembly 72 may be a conventional centrifugal fan that includes a fan or impeller 90, which may be coupled for rotation with the output shaft 88, and a fan housing 92. The fan housing 92 includes an inlet aperture 94 that may be centered about the rotational axis of the impeller 90, and one or more discharge apertures 96, which may be located on a bottom side of the fan housing 92 generally transverse to the inlet aperture 94. Air that is discharged from the discharge aperture 96 may be guided through an associated flow channel 98 that is also integrally formed with the fan housing 92 in the particular example provided. The flow channel 98 may direct the air downwardly and somewhat rearwardly.

The battery pack 74 conventionally includes a plurality of rechargeable batteries 100, which are adapted to be electrically coupled to a source of electrical power, as through the recharging base 75 that is illustrated in FIG. 1. The battery pack 74 may be coupled to the motor 70 and the power switch 76 in a conventional and well known manner. In the alternative, the battery pack 74 may be coupled to the motor 70 by way of an integrated snap connector 108 as illustrated in FIGS. 36 through 39. The snap connector 108 may have a first portion 108*a* that may be integrated with the motor 70 and a second portion 108*b* that may be integrated with the battery pack 74. The first portion 108*a* may include a circuit board 110 with a plurality of terminals, such as blade-type male terminals 112. The circuit board 110 may include all of the integrated circuits and solid state components that are employed for controlling the distribution of electrical power from the battery pack 74 to the motor 70, as well as for controlling the charging of the battery pack 74 (e.g., timers). The second portion 108*b* may include a plurality of mating terminals, such as blade receiving terminals 114, that matingly engage the terminals of the first portion 108*a*. In the particular embodiment illustrated, the blade receiving terminals 114 slidably receive the blade-type male terminals 112 to permit the motor assembly 30 to be coupled to the battery pack 74 prior to their installation to the housing 32.

The battery pack 74 may further include a housing 120 having a pair of engagement features 122 that co-engage mating features 124 (FIG. 11) to permit the battery pack 74 to be coupled to the housing 32 without separate fasteners, etc. In the particular embodiment illustrated, the engagement features 122 are tabs and the mating features 124 are slots that are configured to receive an associated one of the tabs to thereby fixedly but removably couple the battery pack 74 to the housing 32. At least one of the tabs may be a cross-tab (i.e., a tab with two portions that are skewed to one another) that is configured to engage an associated mating feature 124 in a manner that inhibits vertical and horizontal movement of the cross-tab relative to the associated mating feature 124. In the particular embodiment illustrated, the structure into which the cross-tab is received defines a cross-slot (i.e., a slot with two portions for receiving the two portions of the cross-tab), but as those skilled in the art will appreciate from this disclosure, one portion of the cross-tab may be disposed in the slot while the other portion of the cross-tab abuts an end of the structure that defines the slot. Additionally, the housing 120 may house a pair of charging terminals 126 that may be configured to extend through the housing 32 so as to be accessible by the recharging base 75 (FIG. 1) when the vacuum 10*a* is coupled thereto.

One suitable power switch 76 is described in detail in U.S. Pat. No. 5,544,274, which is hereby incorporated by reference as if fully set forth herein. Briefly, and with reference to FIG. 3, the power switch 76 may include a conventional slide switch 76*a* that selectively enables or disables the transmission of electric power therethrough to close or open the electrical circuit between the batteries 100 and the motor 70. The slide switch 76*a* may be fixedly coupled to the circuit board 110 in the particular example provided and employed to move contacts into and out of electrical connection with terminals on the circuit board 110.

Figure 10:
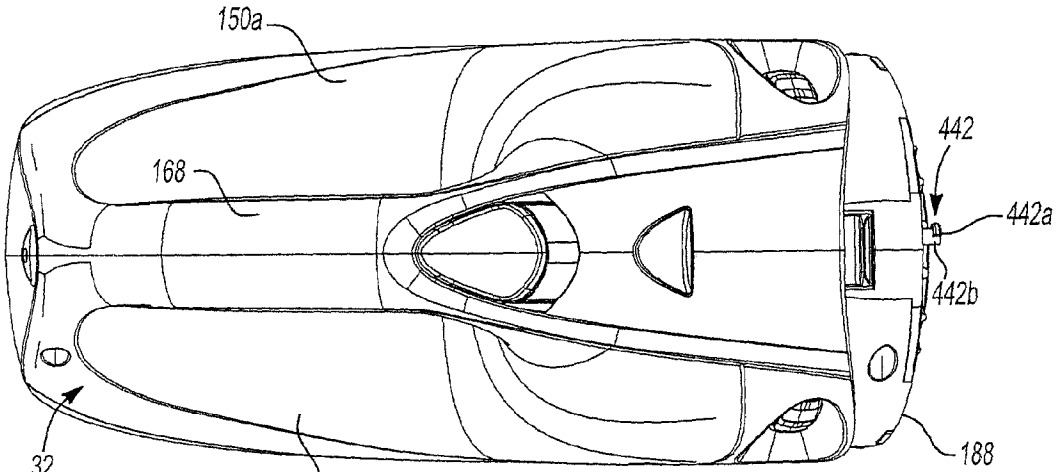
FIG. 10 is a top view of a portion of the vacuum of FIG. 2 illustrating the housing assembly in greater detail.
Figure 11:
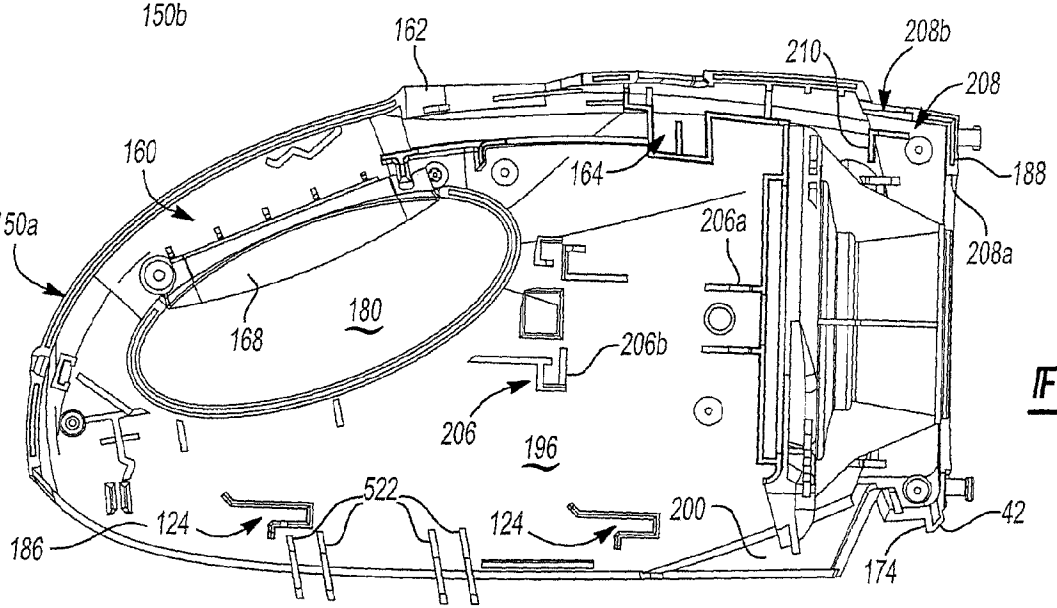
FIG. 11 is a side elevation view of a portion of the housing assembly illustrating a housing shell in greater detail.

With reference to FIGS. 3, 10 and 11, the housing 32 of the particular embodiment provided may include a pair of housing shells 150*a* and 150*b* and an exhaust deflector 154. The housing shells 150*a* and 150*b* may be configured to be coupled together in a conventional and well known manner to define a switch mounting structure 160, a switch aperture 162, a latch mounting structure 164, the retaining tab 42 and a handle 168. The switch mounting structure 160 may be conventionally configured to receive therein and support the power switch 76 of the motor assembly 30 such that the power switch 76 extends through the switch aperture 162 so as to be actuate-able by the user of the vacuum 10*a*.

The latch mounting structure 164 may be configured to receive therein and support the conventional latch mechanism 40 having a latch member 170 for engaging the securing aperture 56*a* in the housing structure 52 of the dirt cup assembly 12 and a spring (not shown) for biasing the latch member 170 upwardly relative to the housing 32.

The retaining tab 42 extends outwardly from the housing 32 and defines an abutting wall 174. The retaining tab 42 may be configured to project through the securing aperture 56*b* when the dirt cup assembly 12 is coupled to the housing assembly 14 to permit the abutting wall 174 to cooperate with the rear edge of the securing aperture 56*b* to thereby limit forward movement of the dirt cup assembly 12 relative to the housing assembly 14.

In the example provided, the handle 168 is integrally formed with the housing shells 150*a* and 150*b* and may extend between the forward and rearward portions of the housing 32 and above the body of the housing 32 to define therebetween a handle aperture 180 that is sized to receive the hand of the user of the vacuum 10*a*. Those skilled in the art will appreciate, however, that the handle 168 may be otherwise positioned and/or a discrete component that is joined or fastened to the remainder of the housing 32 in a known manner.

Except as noted below, each of the housing shells 150*a* and 150*b* may be constructed in an identical manner so that further description of the housing shell 150*a* will suffice for both. With primary reference to FIG. 11 and additional reference to FIG. 12, the housing shell 150*a* includes a wall member 186 that may define a front wall 188, a central cavity 196, an exhaust cavity 200 and a recessed area 202 through which an elliptical through-hole 204 is formed. The wall member 186 may also define a motor mount 206 and a hub mount 208, both of which being disposed in the central cavity 196.

The motor mount 206 may include first and second mount portions 206*a* and 206*b*, respectively, that are employed to fixedly couple the motor 70 to the housing 32. The motor mount 206 may be configured to receive the motor 70 in a snap-fit manner so that discrete fasteners and the like are not required.

The hub mount 208 may include structure which, in association with the fan housing 92 in the example provided, serves to maintain the filter cleaning system 36 in a desired location along a longitudinal axis of the vacuum 10*a* relative to the filter system 34. In the example provided, the hub mount 208 includes first and second bearing portions 208*a* and 208*b*, respectively, which are axially spaced apart along an axis that is coincident with a rotational axis of the motor 70. The first bearing portion 208*a* may be semi-circular in shape so as to form a circular aperture when the housing shells 150*a*, 150*b* are coupled to one another. The second bearing portion 208*b* may include a rear wall 210 that may be generally transverse to the rotational axis of the motor 70.

As is apparent from the discussion above, the fan housing 92 may form the inlet aperture 94 and one or more discharge apertures 96 through which air is introduced and discharged, respectively, from the fan assembly 72. In the particular example provided, the fan housing 92 forms a volute that terminates at the discharge aperture 96. The flow channel 98 may serve as a fluid conduit which couples the discharge aperture 96 with the exhaust cavity 200.

Figure 13:
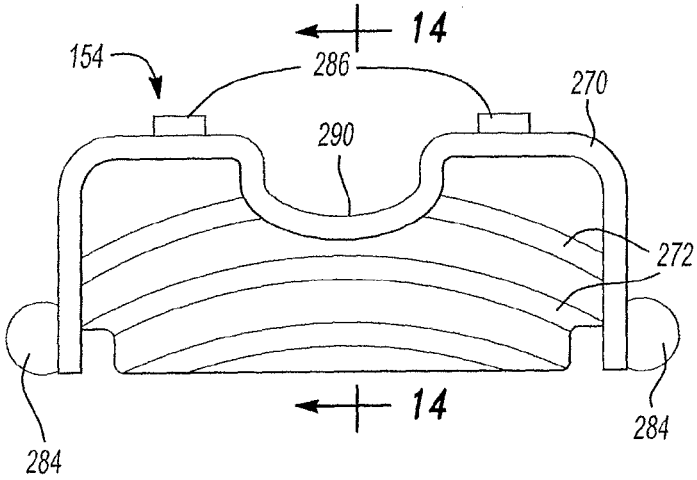
FIG. 13 is a elevation view of a portion of the vacuum of FIG. 2 illustrating the exhaust grille in greater detail.

With specific reference to FIG. 13, the exhaust deflector 154 may include a frame 270 and a plurality of flow guiding vanes 272 that are set into the frame 270 and fixedly coupled thereto. The flow guiding vanes 272 of the particular embodiment illustrated are shaped so as to direct the air exiting the exhaust cavity 200 both downwardly and rearwardly.

Figure 14:
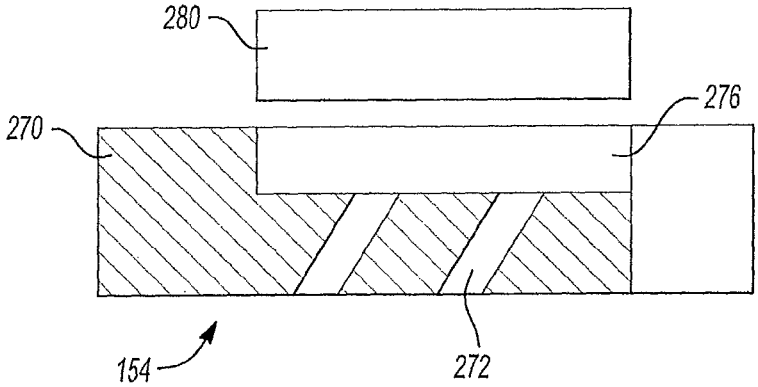
FIG. 14 is section view taken along the line 14-14 of FIG. 13.

With additional reference to FIGS. 3 and 14, the frame 270 of the exhaust deflector 154 may extend upwardly of the flow guiding vanes 272 to create a pocket 276 into which may be fitted an optional exhaust filter 280. The exhaust filter 280 operates to filter the air that exits the exhaust cavity 200 and thereby prevents fine dust particles from being expelled from the vacuum 10*a*. The exhaust filter 280 may be formed from a non-woven mesh fabric so as to be washable should it become undesirably dirty or clogged. Those skilled in the art will appreciate from this disclosure, however, that the exhaust filter 280 may be formed from another washable filter media or may alternately be a disposable type filter (e.g., paper). Those skilled in the art will also appreciate from this disclosure that the exhaust filter may be configured to provide HEPA (high efficiency particulate air) filtration or ULPA (ultra low penetration air) filtration. As used herein, a "HEPA" filter will be understood as being capable of removing 99.97% of particles as small as 0.3 μm from an air flow, while a "ULPA" filter will be understood as being capable of removing 99.999% of particles as small as 0.12 μm from an air flow.

Returning to FIGS. 3 and 13, the frame 270 may also include a pair of trunnions 284 and a pair of clip structures 286. The trunnions 284 permit the exhaust deflector 154 to be pivotably coupled to the housing 32. More specifically, each of the housing shells 150*a* and 150*b* may include a recess (not specifically shown) for receiving an associated one of the trunnions 284. Each trunnion 284 is illustrated as being coupled to a portion of the frame 270 that may be deflected laterally inward (i.e., toward the centerline of the exhaust deflector 154) so that the trunnions 284 may be installed to their respective recess when the housing shells 150*a* and 150*b* are coupled to one another. With the trunnions 284 engaged to recesses, the exhaust deflector 154 may be pivoted between a closed position, wherein the rear surface of the exhaust deflector 154 covers the exhaust cavity 200, and an open position, wherein the exhaust deflector 154 substantially clears the exhaust cavity 200.

The clip structures 286 are configured to resiliently deflect in response to the application of a modest force to the exhaust deflector 154 to permit the exhaust deflector 154 to be secured to or released from the wall member 186 when the exhaust deflector 154 is moved into or out of the closed position. As will be apparent to those of ordinary skill in the art, engagement of the clip structures 286 to the wall member 186 effectively maintains the exhaust deflector 154 in the closed position. Those skilled in the art will also appreciate that features such as recesses or tabs 288 may be formed into the wall member 186 to serve as points that enhance or improve the ability of the clip structures 286 to engage the wall member 186.

Returning to FIGS. 3 and 13, the top of the frame 270 of the exhaust deflector 154 may be arcuately shaped to define a finger grip 290 that is configured to receive the thumb or finger of the user of the vacuum 10*a* so that the thumb or finger may be employed to move the exhaust deflector 154 out of the closed position. The finger grip 290 may include a gripping feature, such as a raised lip, that permits the user to pry downwardly and outwardly on the exhaust deflector 154 with their thumb or finger to thereby disengage the clip structures 286 from the wall member 186.

Figure 12:
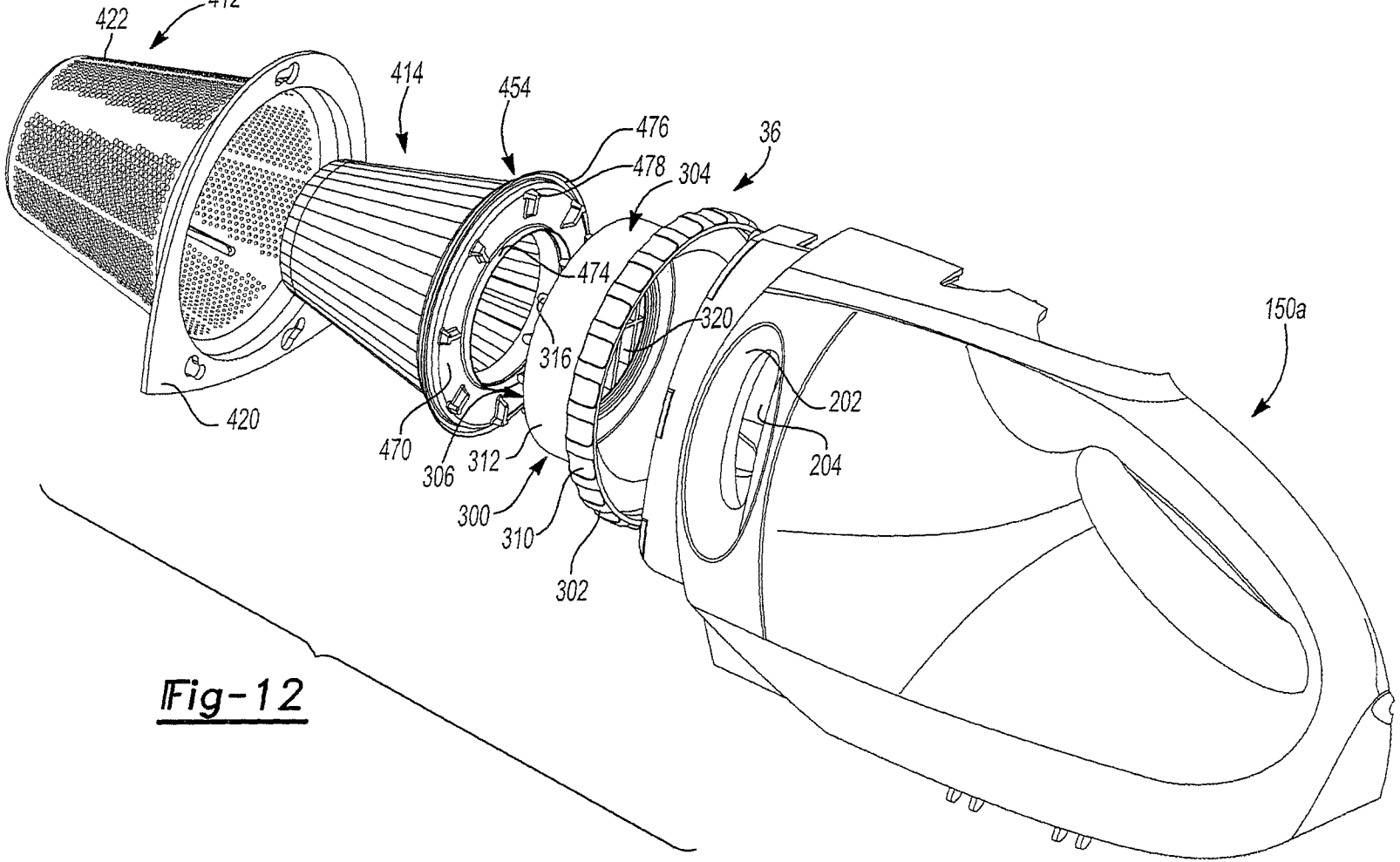
FIG. 12 is an exploded perspective view of a portion of the housing assembly.
Figure 15:
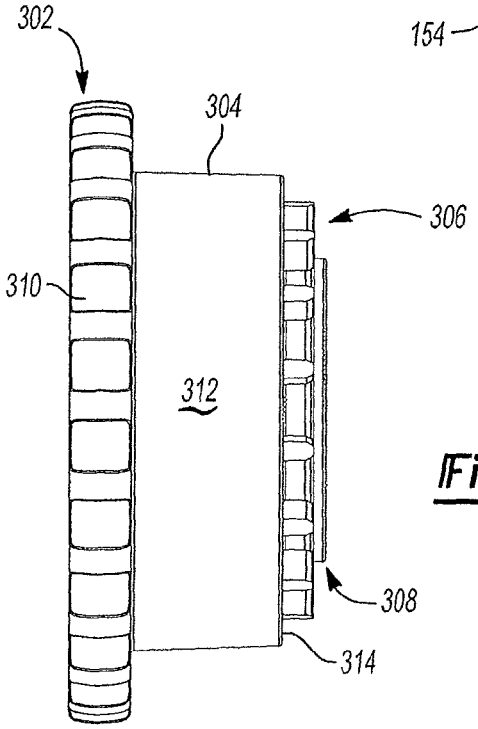
FIG. 15 is a side elevation view of a portion of the vacuum of FIG. 2 illustrating the cleaning wheel in greater detail.

With renewed reference to FIG. 12, the filter cleaning system 36 may include a cleaning wheel 300 that is housed by the housing 32. With additional reference to FIGS. 3, 15 and 16, the cleaning wheel 300 may be generally hollow and may include a gripping portion 302, a hub portion 304, a filter drive portion 306 and a filter engagement portion 308. The gripping portion 302 may be an annular ring that may be coupled to the rearward side of the hub portion 304 and which may include a plurality of circumferentially spaced apart recesses 310. The hub portion 304 may define a bearing surface 312 that may be journally supported by the housing 32. The filter drive portion 306 may be formed on a wall 314 that is coupled to the hub portion 304 generally transverse to the bearing surface 312.

In the particular example provided, the filter drive portion 306 includes a plurality of radially extending drive tabs 316 that are circumferentially spaced apart from one another and collectively oriented concentric with the bearing surface 312. Those skilled in the art will appreciate from this disclosure, however, that the filter engagement portion 308, through frictional engagement or other engagement with the primary filter 414, may also serve in whole or in part as the filter drive portion 306.

The filter engagement portion 308 may be an elongated annular structure that may extend forwardly from the wall 314 of the filter drive portion 306. The cleaning wheel 300 may also include a grille 320 which inhibits the passage of relatively large objects from passing through the cleaning wheel 300 and contacting the impeller 90.

Figure 17:
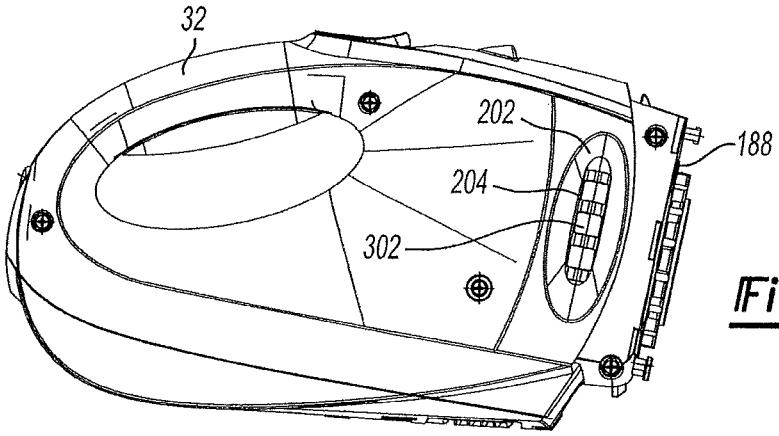
FIG. 17 is a side elevation view of the housing assembly.

The cleaning wheel 300 may be installed over the fan housing 92 prior to the installation of the motor 70 and fan assembly 72 to the housing 32, thereby permitting these components to be collectively assembled to one of the housing shells (e.g., housing shell 150*a*) substantially simultaneously. The cleaning wheel 300 may be positioned relative to the housing 32 such that gripping portion 302 partially extends through the elliptical through-holes 204 in the recessed areas 202 of the housing 32 as shown in FIG. 17. Once the cleaning wheel 300 has been installed to the housing 32, movement of the cleaning wheel 300 in an axial direction along the rotational axis of the motor 70 may be limited through contact between the gripping portion 302 and housing 32 along the perimeter of the elliptical through-holes 204. Additionally or alternatively, contact with the fan housing 92 and the rear wall 210 of the second bearing portion 208*b* (FIG. 11) may be employed to limit movement of the cleaning wheel 300 axially along the rotational axis of the motor 70.

The first and second bearing portions 208*a* and 208*b* of the hub mount 208, however, cooperate with the bearing surface 312 to limit the movement of the cleaning wheel 300 vertically and horizontally relative to the rotational axis of the motor 70, but permit the cleaning wheel to be rotated about the rotational axis of the motor 70. The recesses 310 in the gripping portion are specifically configured to be gripped by the thumb and/or fingers of a user of the vacuum 10*a* to rotate the cleaning wheel 300.

Figure 18:
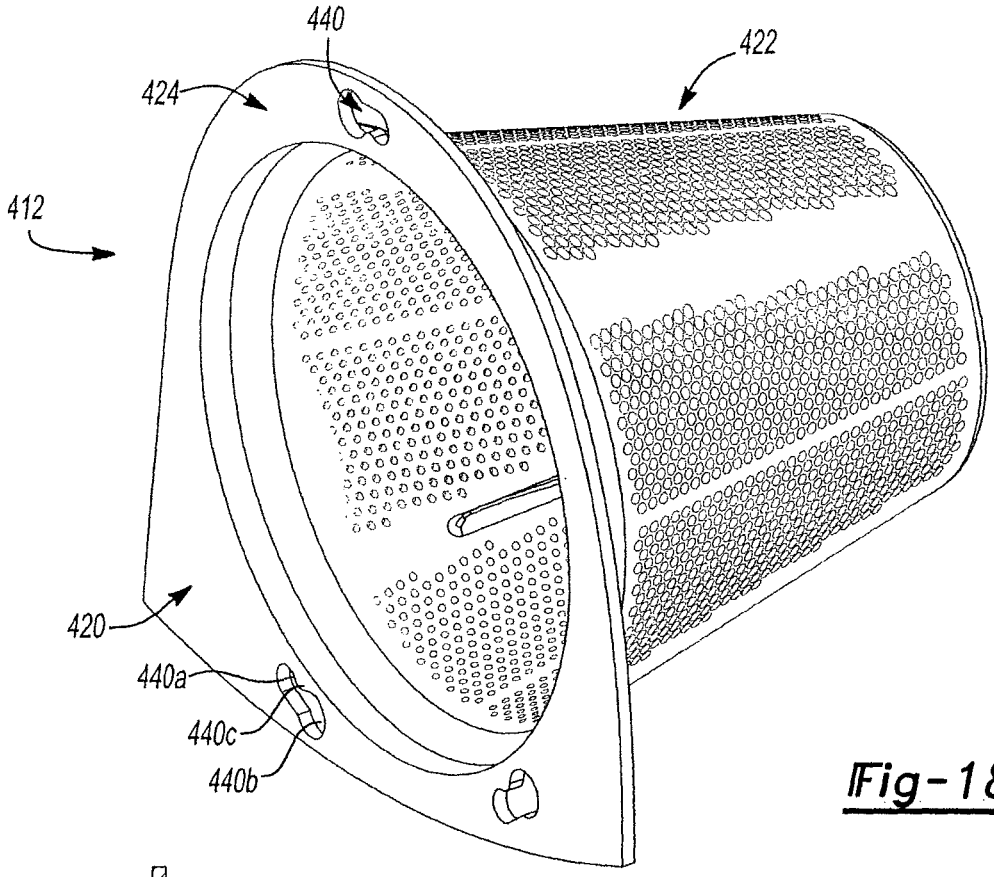
FIG. 18 is a perspective view of a portion of the housing assembly illustrating the prefilter in greater detail.

In FIGS. 3 and 12, the filter system 34 may include an intake filter 400 and the above-discussed optional exhaust filter 280. The intake filter 400 may include a prefilter 412 and a primary filter 414. In FIG. 18 and with additional reference to FIGS. 10 and 16, the prefilter 412 may include a filter flange 420, a prefilter body 422 and a securing means 424 for releasably securing the prefilter 412 to the housing 32. The filter flange 420 may extend radially outwardly from the prefilter body 422 and may be configured to abut the front face 188 of the housing 32. The filter flange 420 may be unitarily formed with the remainder of the prefilter 412 from a material that is structural, such as polyethylene or polypropylene. Those skilled in the art will appreciate, however, that the filter flange 420 could alternatively include a resilient band of material (not shown) that is coupled to the remainder of the filter flange 420, via a mechanical connection, adhesives or overmolding, and employed to sealingly engage at least one of the housing 32 and the dirt cup 20.

Figure 19:
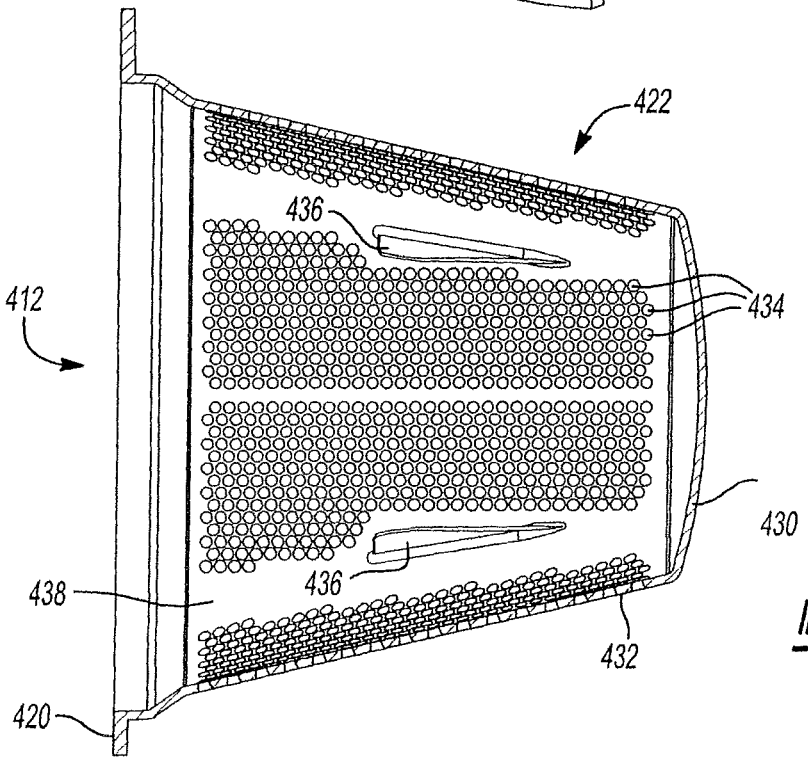
FIG. 19 is a longitudinal section view of the prefilter.

With additional reference to FIG. 19, the prefilter body 422 may have a truncated cone shape, with a front wall 430 and a side wall 432 that has a plurality of filtering apertures 434 formed therethrough. The filtering apertures 434 may be sized to prevent relatively coarse dirt and debris from contacting the primary filter 414 (FIG. 3). In the example provided, the filtering apertures 434 are about 0.020 inch (0.5 mm) to about 0.040 inch (1.0 mm) in diameter. In the particular embodiment provided, one or more ribs 436 are formed on the interior surface 438 of the side wall 432. The ribs 436 will be discussed in greater detail, below.

As those of ordinary skill in the art will appreciate from this disclosure, any appropriate means may be employed to removably couple the filter flange 420 to one or both of the housing 32 and the dirt cup 20. Preferably, the securing means 424 will not automatically detach from the housing 32 when the dirt cup 20 is removed from the housing 32.

Figure 16:
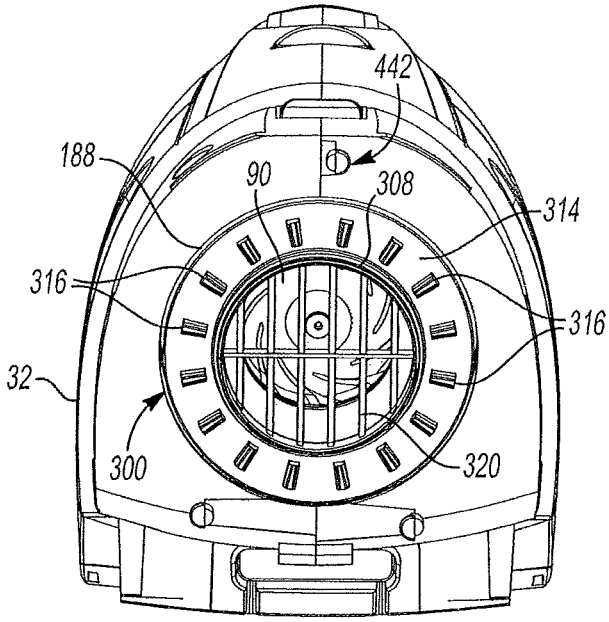
FIG. 16 is a front elevation view of the housing assembly.

In the particular example provided, the securing means 424 is illustrated in FIG. 18 to include a plurality of holes 440 that are configured to receive therethrough corresponding pegs 442 that extend from the front face 188 of the housing 32 as illustrated in FIG. 16. The holes 440 may be shaped to directly correspond to the shape of the pegs 442, but in the example illustrated, include first and second portions 440*a* and 440*b*, respectively, that intersect one another. The first portion 440*a* is relatively large and configured to receive therethrough an associated peg 442, which is illustrated in FIG. 10 to include a relatively large head portion 442*a* and a somewhat smaller body portion 442*b*. In contrast, the second portion 440*b* is configured only to receive therethrough the body portion 442*b* of the associated peg 442. Accordingly, once the prefilter 412 has been installed over the pegs 442, it may be rotated to position the body portion 442*b* of the pegs 442 into the second portion 440*b* of the holes 440. As the head portion 442*a* of the pegs 442 is relatively larger than the second portion 440*b*, the filter flange 420 will remain attached to the housing 32 when the dirt cup 20 is removed, unless the filter flange 420 is rotated to align the pegs 442 with the first portion 440*a* of the holes 440.

To guard against undesired rotation of the filter flange 420 relative to the housing 32 when the dirt cup 20 has been removed from the rear housing, the securing means 424 may include a resilient finger 440*c* that contacts the body portion 442*b* of an associated peg 442 to inhibit rotation of the filter flange 420 unless a force in excess of a predetermined force has been applied to rotate the filter flange 420 in a desired rotational direction relative to the housing 32.

Figure 20:
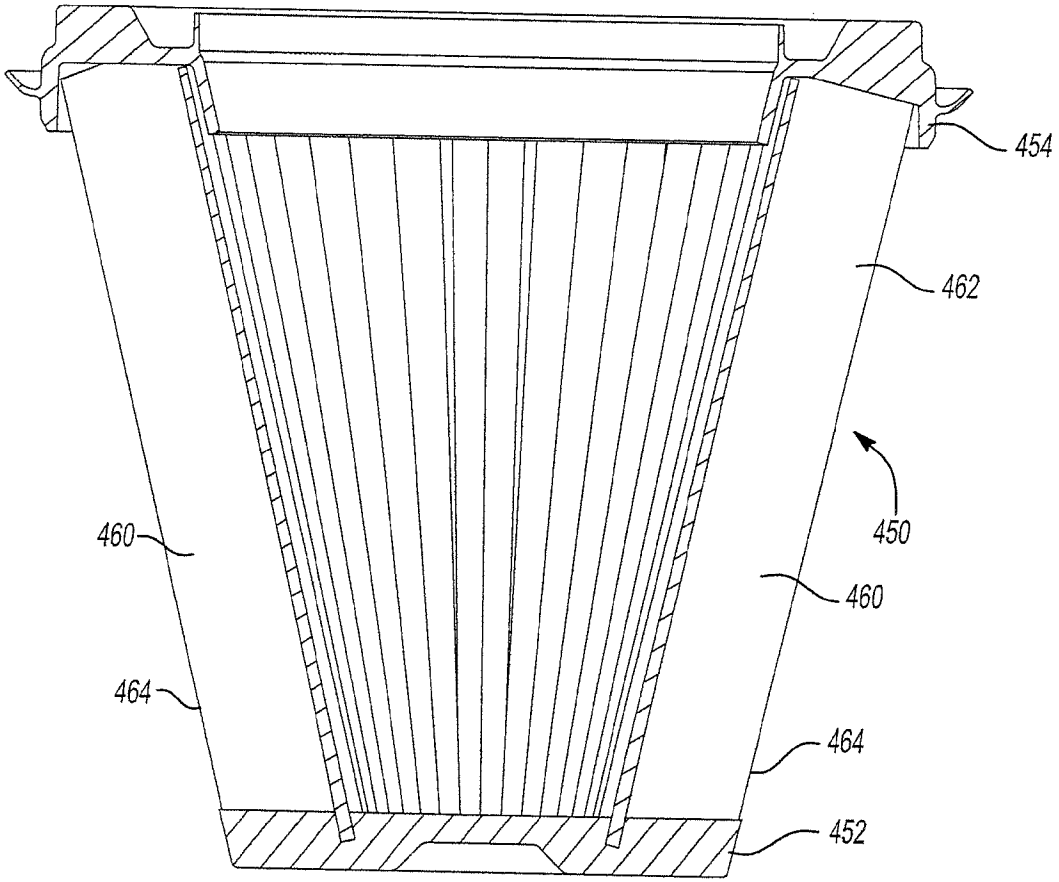
FIG. 20 is a longitudinal section view of the primary filter.

In FIG. 20, the primary filter 414 may have a filter body 450 with first and second seal portions 452 and 454, respectively, disposed on opposite sides thereof. The filter body 450 may have a shape that is similar to that of the prefilter body 422 (FIG. 19) and in the example provided, is illustrated to have a truncated cone shape. The filter body 450 may be formed from any appropriate filter media, such as paper, plastic or fabric and is preferably formed with a plurality of pleats 460. Also preferably, the filter media is wear resistant or includes a wear resistant outer layer 462. Furthermore, the filter body 450 is preferably formed from a filter media that provides HEPA or ULPA filtration. One such suitable filter media is manufactured by W.L. Gore & Associates, a Delaware Corporation having a place of business in Elkton, Md.

In the example provided, the pleats 460 are formed such that their outer ends or peaks 464 lie along a straight line that intersects the axis of a theoretical cone (not shown) that includes the peak 464 of each pleat 460 on the filter body 450. Alternatively, the pleats 460 may be formed such that their peaks 464 are straight but skewed to the axis of the theoretical cone or generally helical in shape. For reasons that will be apparent from the discussion below, however, the pleats 460 should be formed relative to the theoretical cone in a manner that is consistent with the ribs 436 on the interior surface 438 of the filter housing 432.

The first seal portion 452, which is coupled to the smaller end of the filter body 450, may be a plate-like structure that is formed from a suitable material and is sealingly bonded to a lower end of the filter body 450. Alternatively, the first seal portion 452 may be wholly or partially formed from an appropriate filter material, such as the material from which the filter body 450 is manufactured, and bonded or otherwise sealingly coupled to the filter body 450.

Figure 21:
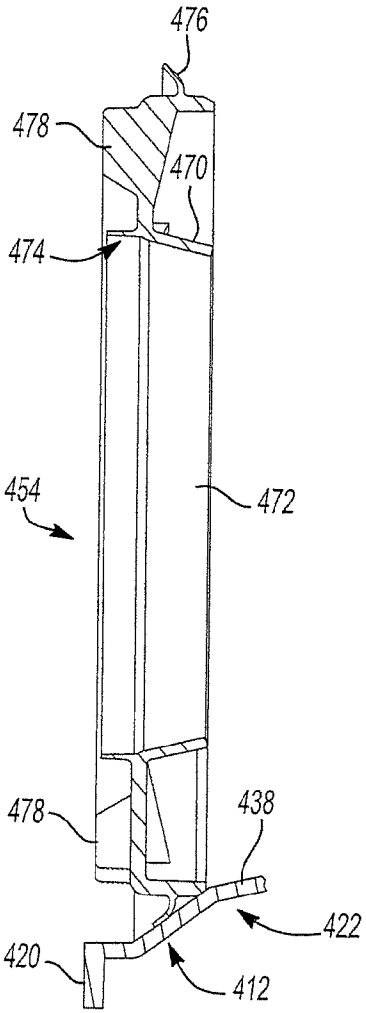
FIG. 21 is a longitudinal section view of a portion of the housing assembly illustrating the second seal portion of the primary filter in sealing engagement with the prefilter.

The second seal portion 454 may be an annular flange that may be sealingly bonded to an upper end of the filter body 450. With additional reference to FIGS. 12 and 21, the second seal portion 454 may include a body 470 that defines a receiving aperture 472, a primary seal 474 which is disposed about the perimeter of the receiving aperture 472 and sized to sealingly engage the seal engaging portion 308 of the cleaning wheel 300 (FIG. 15), a secondary seal 476 that sealingly engages the interior surface 438 of the prefilter body 422 of the prefilter 412, and a plurality of drive tabs 478. The drive tabs 478, which extend radially outward and are circumferentially spaced apart from one another, are configured to engage the drive tabs 316 that are formed on the filter drive portion 306 of the cleaning wheel 300.

With the primary filter 414 installed to the cleaning wheel 300 such that the primary seal 474 sealingly engages the seal engaging portion 308 and the drive tabs 316 and 478 are meshingly engaged with one another, the prefilter 412 may be positioned over the primary filter 414 such that the first portion 440*a* of the through-holes 204 in the filter flange 420 are aligned to the pegs 442 on the housing 32. The prefilter 412 may be urged toward the housing 32 such that the pegs 442 are fitted through the through-holes 204 and thereafter the prefilter 412 is rotated to position the pegs 442 within the second portion 440*b* of the through-holes 204. With the dirt cup 20 coupled to the housing assembly 14, the prefilter locating tabs 58 urge the filter flange 420 rearwardly toward the front face 188 of the housing 32 so that the secondary seal 476 sealingly engages the prefilter body 422 of the prefilter 412.

Figure 40:
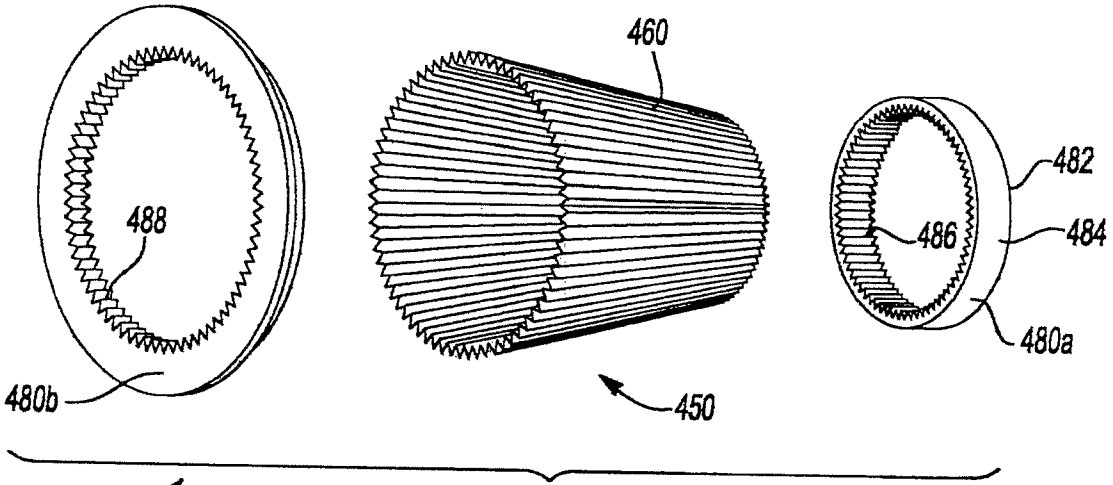
FIG. 40 is an exploded perspective view of an alternately constructed primary filter.
Figure 41:
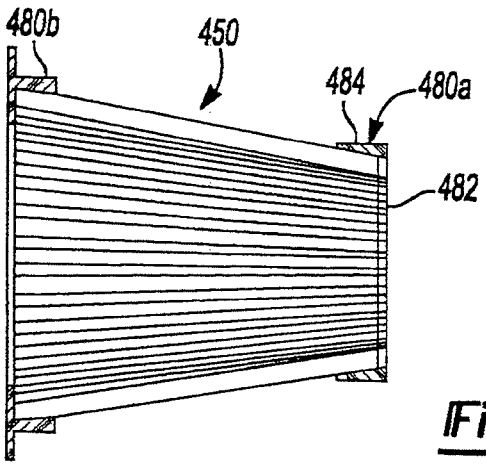
FIG. 41 is a longitudinal section view of the primary filter of FIG. 40.

While the primary filter 414 has been illustrated and described as including first and second seal portions 452 and 454 which are bonded directly to the filter body 450, the primary filter 414 may be formed in various other manners. For example, the primary filter 414 may include a pair of discretely formed, caps 480*a* and 480*b* as illustrated in FIGS. 40 and 41. The cap 480*a* may be generally cup shaped, with a closed top 482 and a side wall 484 with a plurality of teeth 486 formed about the inside perimeter of the side wall 484. The cap 480*b* may be an annular ring that similarly includes a plurality of teeth 488 formed about its inside perimeter. The caps 480*a*, 480*b* may be secured to the opposite ends of the filter body 450 through an adhesive, heat staking or sonic welding, for example, so that the teeth 486 and 488 of the caps 480*a* and 480*b* meshingly engage the pleats 460 of the filter media. The first seal portion 452 may be integrally formed with, molded onto or bonded to the annular cap 480*b*. The second seal portion 454 is optional in this embodiment, as the cap 480*a* may be formed with a closed configuration, rather than the annular shape of the cap 480*b*.

Figure 42:
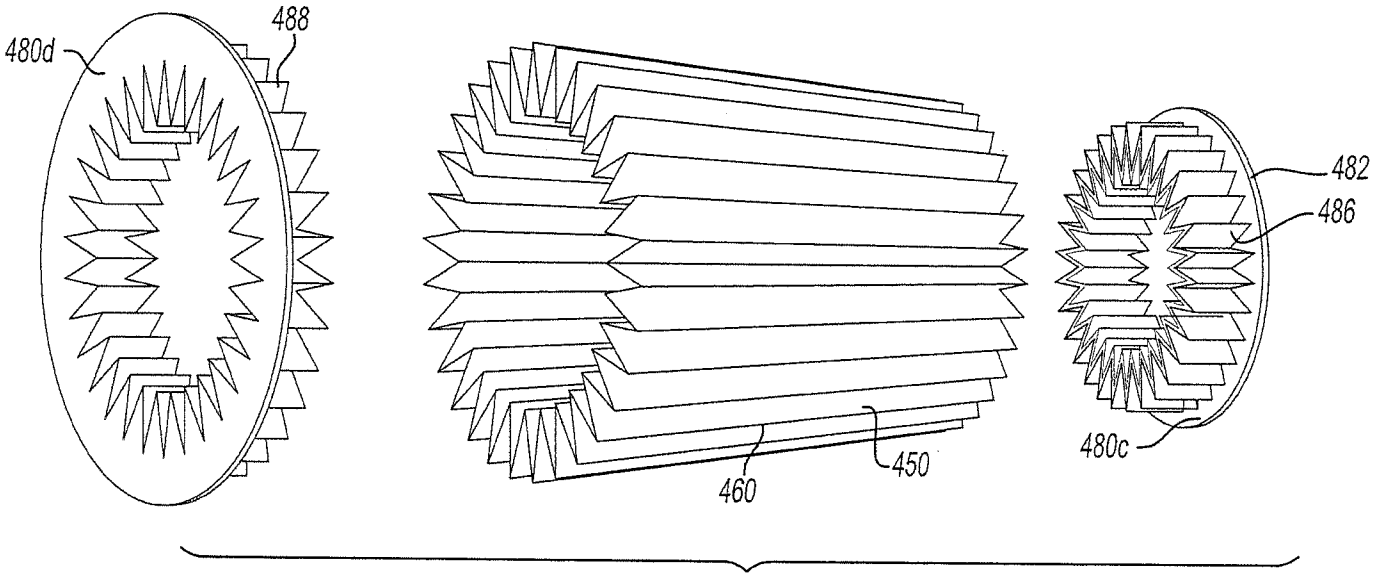
FIG. 42 is an exploded perspective view of another alternately constructed primary filter.
Figure 43:
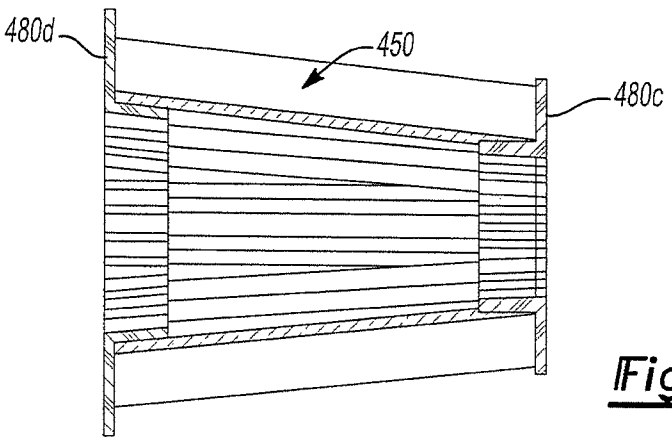
FIG. 43 is a longitudinal section view of the primary filter of FIG. 42.

The embodiment of FIGS. 42 and 43 is similar to that discussed above in that it likewise employs a pair of discretely formed caps 480*c* and 480*d*. However, the teeth 486 and 488 are formed on the exterior surfaces of the caps 480*c* and 480*d* so as to meshingly engage the pleats 460 from the interior of the filter body 450.

Figure 44:
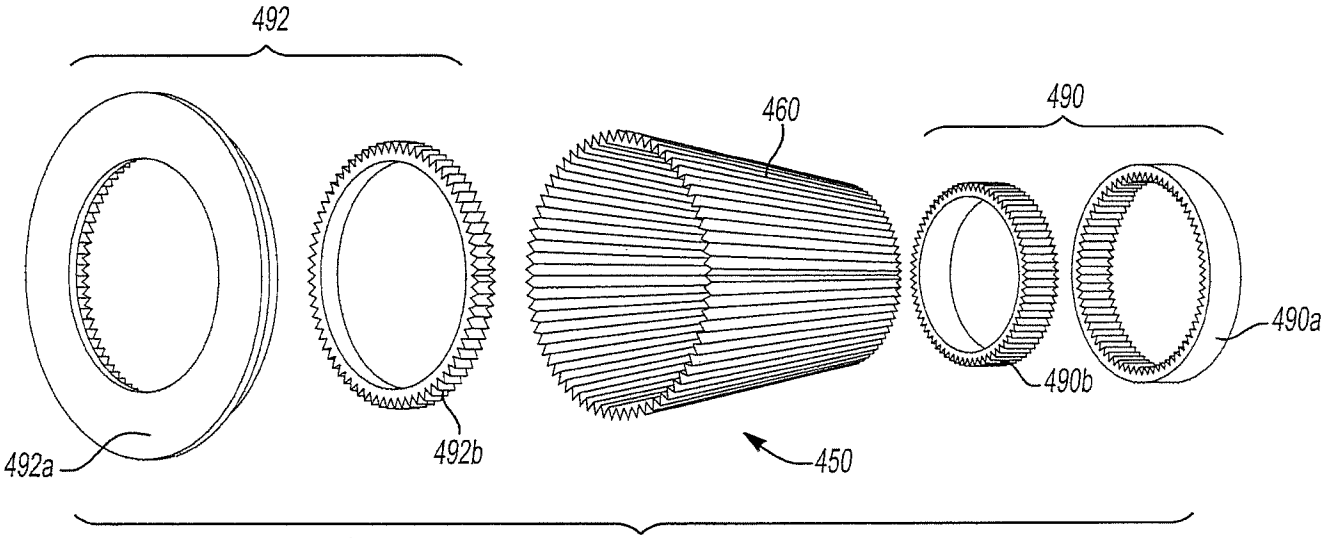
FIG. 44 is an exploded perspective view of yet another alternately constructed primary filter.
Figure 45:
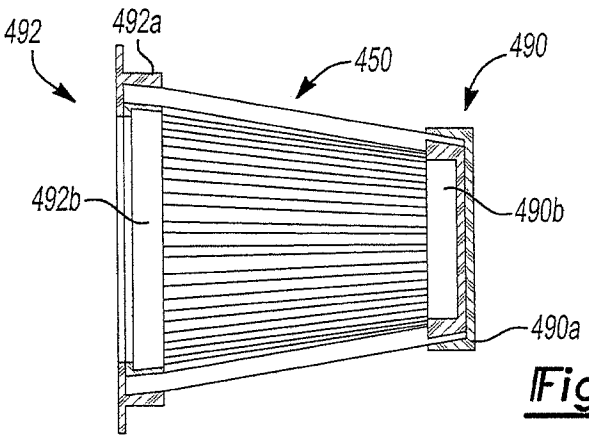
FIG. 45 is a longitudinal section view of the primary filter of FIG. 44.

The embodiment of FIGS. 44 and 45 employs a pair of ring sets 490 and 492. The ring set 490 may include an outer ring 490*a*, which may be similar to the cap 480*a*, and an inner ring 490*b*, which may be similar to the cap 480*c*. The outer and inner rings 490*a* and 490*b* are assembled to the filter body 450 such that the filter media is sandwiched therebetween and secured to the filter body 450 and/or to one another via an adhesive, heat staking or sonic welding, for example. Likewise, the ring set 492 includes an outer ring 492*a*, which may be similar to the cap 480*b*, and an inner ring 492*b*, which may be similar to the cap 480*d*. The outer and inner rings 492*a* and 492*b* are assembled to the filter body 450 such that the filter media is sandwiched therebetween. The outer and inner rings 492*a* and 492*b* are secured to the filter body 450 and/or to one another via an adhesive, heat staking or sonic welding, for example.

Figure 8:
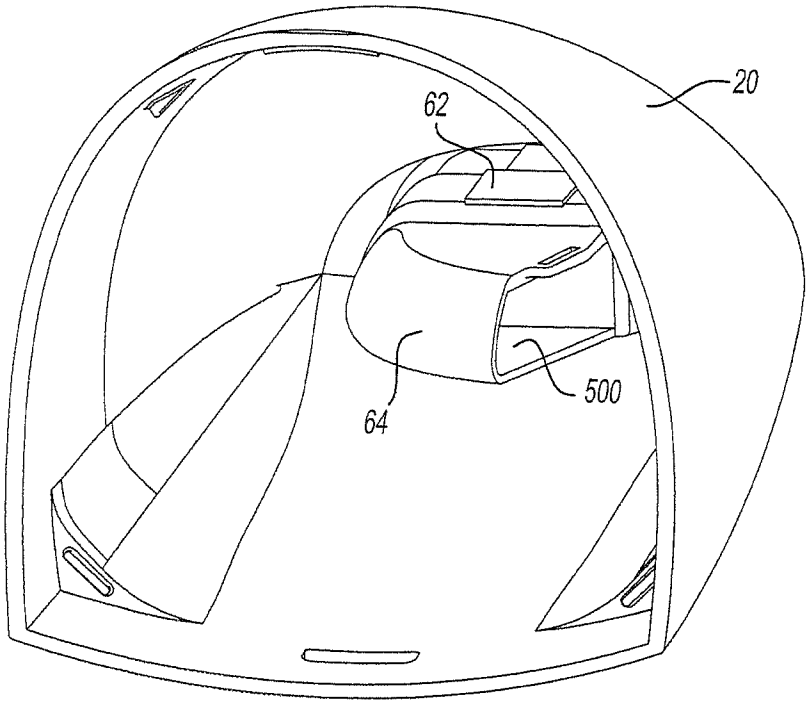
FIG. 8 is a perspective view illustrating the interior of the dirt cup assembly.
Figure 9:
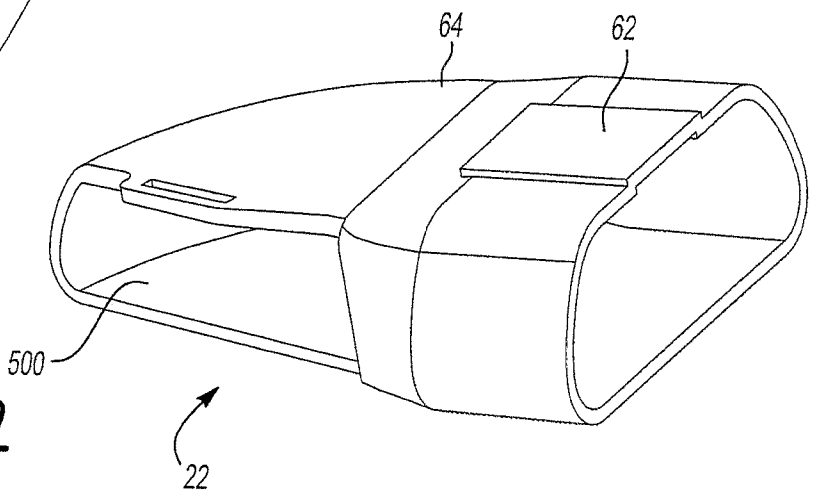
FIG. 9 is a perspective view of a portion of the dirt cup assembly illustrating the elbow in greater detail.

With reference to FIGS. 3 and 8, when the vacuum 10*a* is operated, the fan assembly 72 expels air from the fan housing 92 which creates a negative pressure differential relative to atmospheric conditions and causes a dirt and debris laden air flow to rush into the dirt cup 20 through the inlet port 54. When coupled to the inlet port 54, the elbow 22 directs the dirt and debris laden air that is flowing through the inlet port 54 toward the interior wall of the dirt cup 20, causing the dirt and debris laden air to swirl about the interior of the dirt cup. In the particular example provided, the outlet 500 of the elbow 22 is configured to direct the dirt and debris laden air flow in a direction to the side and rear of the dirt cup 20 (i.e., the outlet 500 of the elbow 22 is configured to change a flow path of air exiting the inlet port 54 by an angle of less than 90 degrees). Those of ordinary skill in the art will appreciate from this disclosure, however, that the elbow 22 may be configured to direct the dirt and debris laden air flow in a direction generally transverse to the inlet port 54, that the outlet 500 of the elbow 22 may or may not lie in the same "plane" as the inlet port 54 (i.e., the centerline of the elbow 22 at the outlet 500 may or may not lie in a plane that is contains the centerline of the inlet port 54) and that any portion of the elbow 22 between the outlet 22 and the inlet port 54 may be formed with a desired shape (e.g., helical) to enhance the swirling effect produced by the elbow 22 and the dirt cup 20.

In some situations, the swirling effect may be so strong as to create centrifugal force that causes the dirt and debris to move outwardly toward and collect against the dirt cup 20. The swirling effect may also slow the collection of dirt and debris on the prefilter 412 and the primary filter 414 to thereby provide improved efficiency of the vacuum 10*a*. Improved efficiency is particularly important with cordless vacuums, as it permits extended operation on a given battery charge. Those of ordinary skill in the art will readily appreciate in view of this disclosure that the swirling effect may not be desirable under some circumstances and as such, the elbow 22 may be removable from the inlet port 54.

With reference to FIGS. 3, 12, 19 and 20, the vacuum 10*a* may be additionally and further maintained in an efficient state by rotating the cleaning wheel 300 as needed or at a desired interval when the impeller 90 is not rotating to at least partially clear accumulated dirt and debris from the pleats 460 of the primary filter 414. More specifically, as the primary filter may be coupled to the cleaning wheel 300, rotation of the cleaning wheel 300 causes contact between the ribs 436 and an associated set of the pleats 460 which may deflect the pleats 460 and vibrate the pleats 460 after the pleat 460 has rotated past the rib 436. The force of the impact, the deflection of the pleat 460 and its subsequent vibration may cooperate to dislodge particles of dirt and debris from both the prefilter 412 and the primary filter 414.

Figure 46:
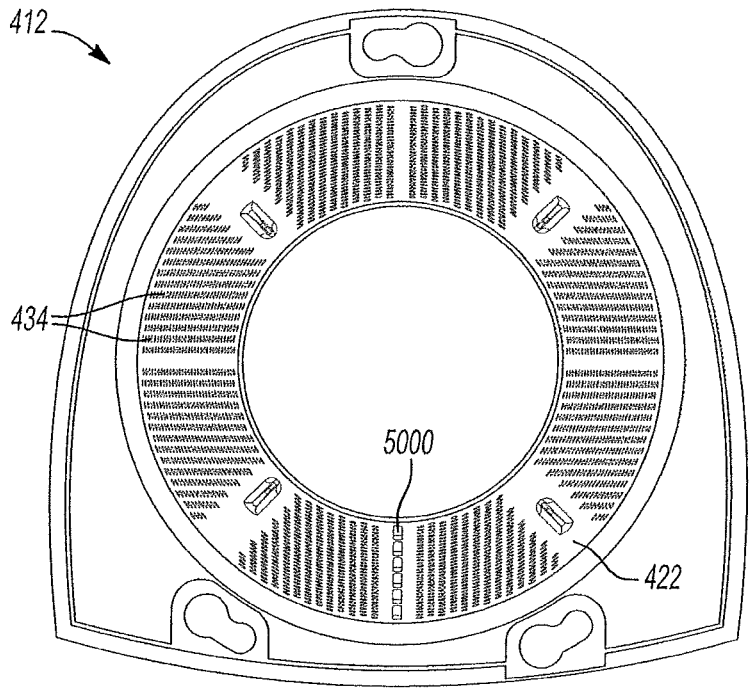
FIG. 46 is a rear view of another prefilter constructed in accordance with the teachings of the present invention.
Figure 47:
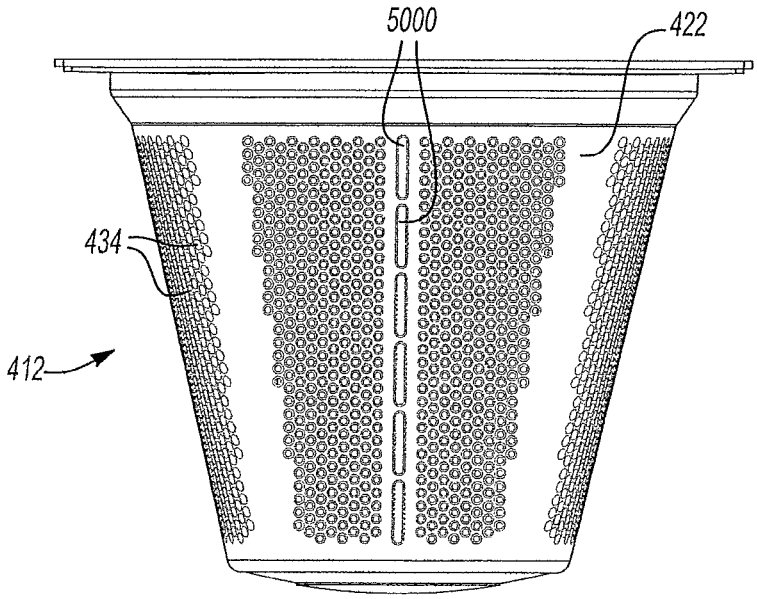
FIG. 47 is a bottom view of the prefilter of FIG. 46.
Figure 48:
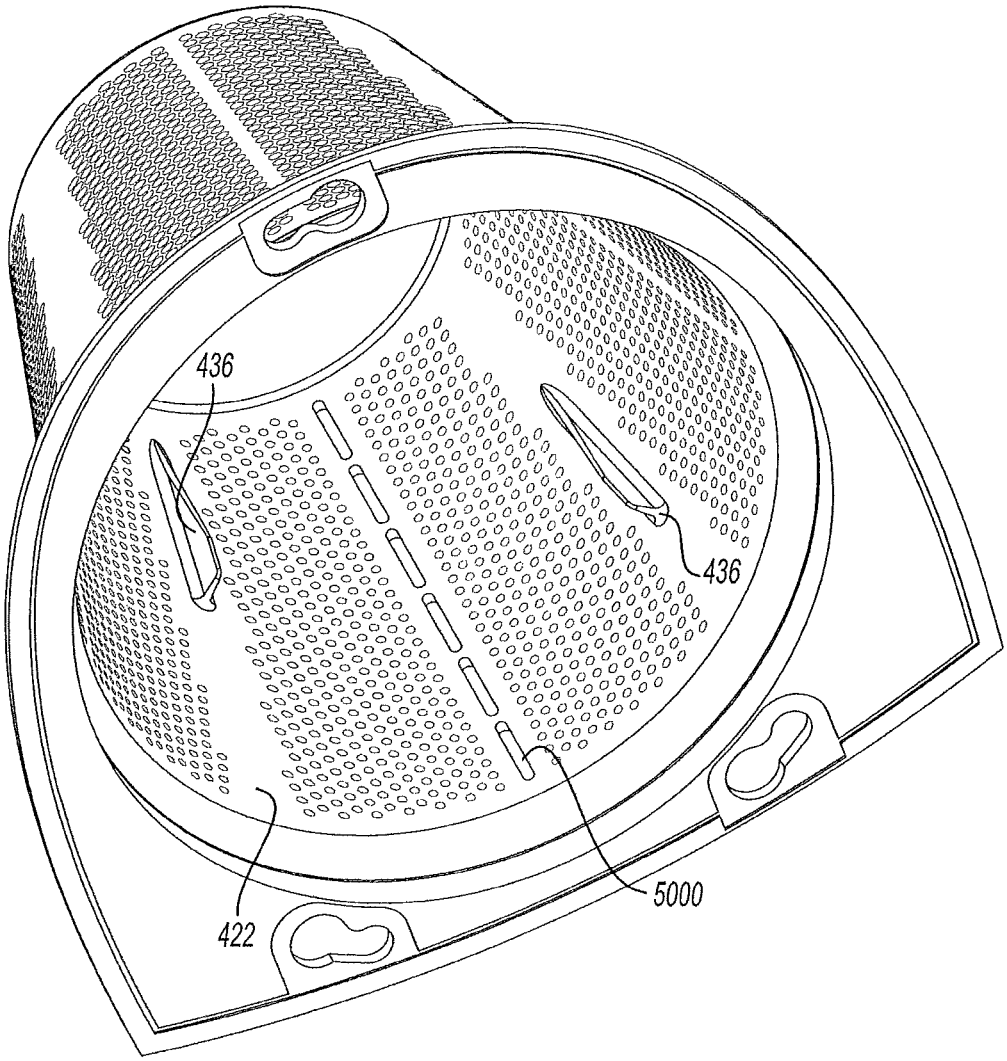
FIG. 48 is a perspective view of yet another prefilter constructed in accordance with the teachings of the present invention.

Those skilled in the art will appreciate from this disclosure that various modifications may be made to the prefilter 412 to aid in discharging dirt and debris that are dislodged from the primary filter 414 and/or to slow the rate with which the pleats 460 of the primary filter 414 wear. For example, the prefilter 412 may be constructed with one or more apertures 5000 as shown in FIGS. 46 and 47. The apertures 5000 are relatively larger than the filtering apertures 434 so that dirt and debris that are dislodged from the primary filter 414 (FIG. 20) during cleaning, e.g., rotation of the cleaning wheel 300 (FIG. 15), may more readily fall through the prefilter body 422 and collect in the dirt cup 20 (FIG. 1). In the example of FIG. 48, the prefilter body 422 is constructed such that at least a portion of the ribs 436 are shifted along the longitudinal axis of the prefilter body 422. In the particular example provided, each of the ribs 436 is shifted so that no two ribs 436 contact the same area of the pleats 460 (FIG. 20).

Returning to FIGS. 1 and 3, the tool set 10*b* may include a brush tool 500 and a crevice tool 502 that may be fixedly but removably engaged to the front end of the inlet port 54 via a friction fit. Unlike the known configurations of accessories, the brush tool 500 and crevice tool 502 each employ a body portion 504 having first and second portions 506 and 508 with a U-shaped aperture 510 formed therebetween. The U-shaped aperture 510 permits a relatively large degree of flexure between the first and second portions 506 and 508 so as to ensure high quality friction fit and associated seal between the body portion 504 and inlet port 54 of the dirt cup 20.

In the particular example provided, the brush tool 500 may be stored in a cavity 518 formed in the rear of the housing 32, while the crevice tool 502 may be coupled to a bottom face 520 of the housing 32. One or more resilient clips 522 may be employed to retain the particular accessory to the housing 32.

Figures 22, 24:
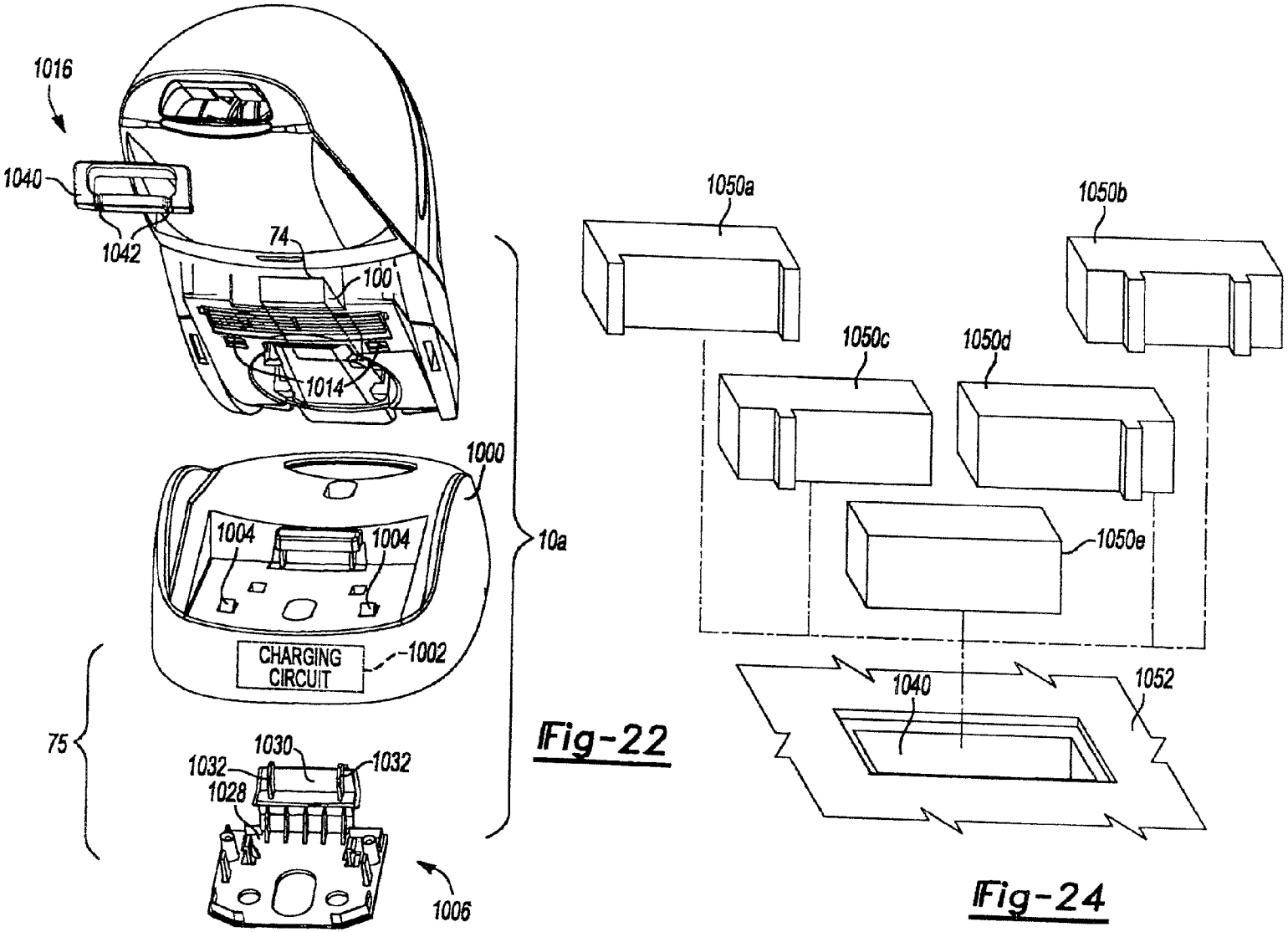
FIG. 22 is an exploded perspective view of the vacuum and recharging base of FIG. 1.
FIG. 24 is a schematic illustration of a portion of an injection mold for forming the mating key that is associated with the vacuum in the example provided.

With reference to FIG. 22, the recharging base 75 is illustrated in association with the vacuum 10*a*. The recharging base 75 may include a base 1000, a charging circuit 1002, a pair of terminals 1004 and a key 1006. The base 1000 may be a molded structure and may be configured to slidably receive the vacuum 10*a* such that a pair of mating terminals 1014 and a mating key 1016 matingly engage the terminals 1004 and the key 1006, respectively. The charging circuit 1002 may be configured in a conventional and well known manner to receive electrical power from a source of A.C. power and provide a source of D.C. power of a predetermined voltage to the terminals 1004.

In the particular example provided, the terminals 1004, which may be mounted to the base 1000, may extend outwardly from the base 1000 so as to contact associated ones of the mating terminals 1014 when the vacuum 10*a* is fully received into the base 1000. As the terminals 1014 are electrically coupled to the battery pack 74, contact between the terminals 1004 and 1014 permits electrical energy to be transmitted from the charging circuit 1002 to the batteries 100.

The key 1006 and the mating key 1016 coordinate with one another to permit the base 1000 to fully receive the vacuum 10*a*. In the particular example provided, the key 1006 includes a pedestal 1028, a flange 1030 and optionally one or more engagement tabs 1032, while the mating key 1016 includes a receiver 1040. The pedestal 1028 of the key 1006 may be coupled to the base 1000 in any conventional manner, including for example, threaded fasteners and/or features that are integrally formed onto and/or into the pedestal 1028 and base 1000 that permit the pedestal 1028 and the base 1000 to be engaged to one another in a snap-fit manner. The flange 1030 may be coupled to the pedestal 1028, extending upwardly therefrom so as to protrude from a corresponding aperture 1036 in the base 1000 when the key 1006 and the base 1000 are coupled to one another. If employed, the engagement tabs 1032 extend from the flange 1030 in the example provided.

The receiver 1040 may be coupled to the housing 32 in any conventional manner, including for example, threaded fasteners and/or features that are integrally formed onto and/or into the receiver 1040 and housing 32 that permit the receiver 1040 and the housing 32 to be engaged to one another in a snap-fit manner. The receiver 1040 of the mating key 1016 may optionally include one or more slots 1042 for receiving the engagement tabs 1032. The engagement tabs 1032 and slots 1042 are positioned such that they must engage one another before the terminals 1020 and 1022 may contact one another. Those of ordinary skill in the art will appreciate from this disclosure that although the vacuum 10*a* has been described thus far as including slots 1042 for receiving engagement tabs 1032 that are associated with the recharging base 75, the slots 1042 and engagement tabs 1032 may alternatively be associated with the recharging base 75 and the vacuum 10*a*, respectively.

Figure 23:
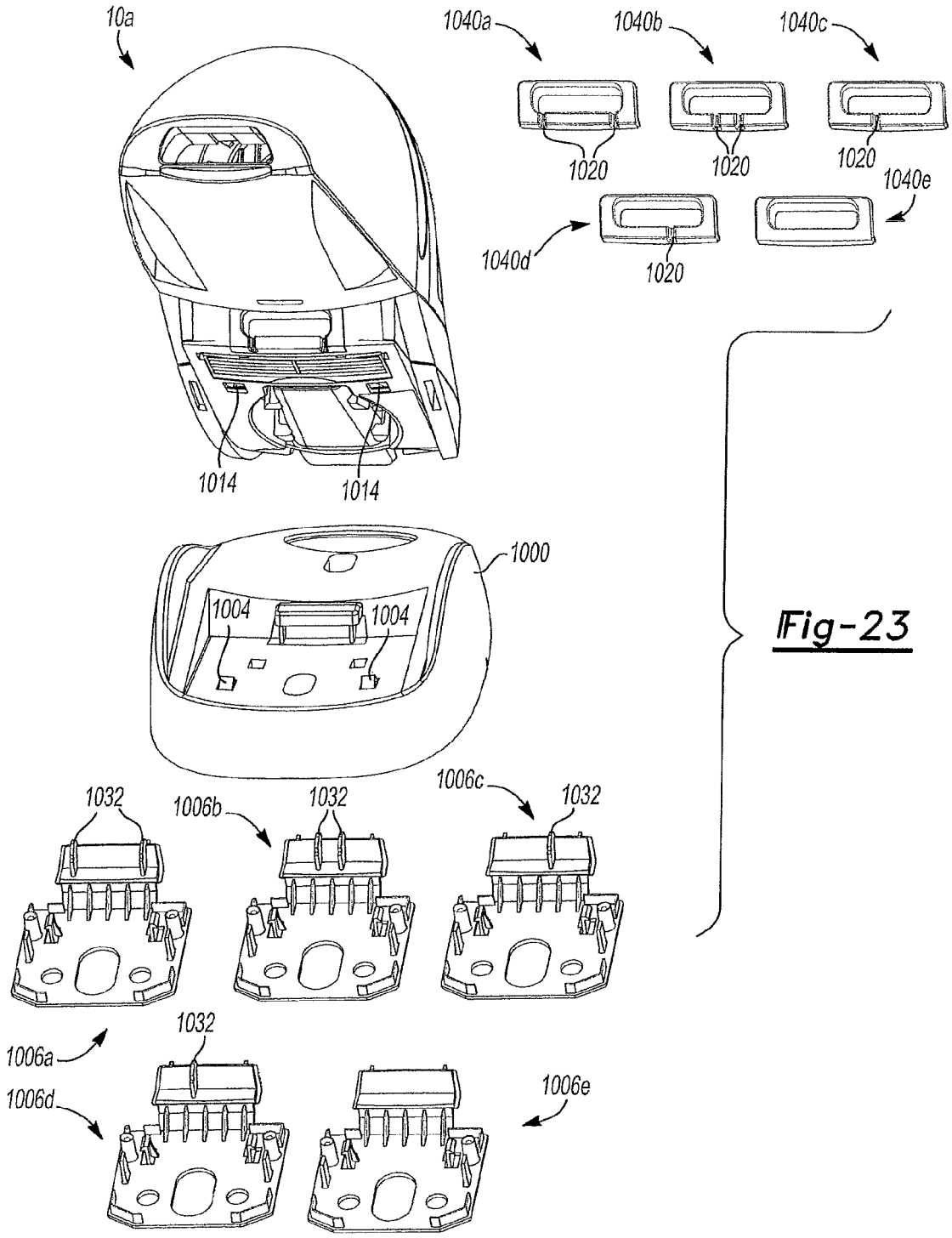
FIG. 23 is an exploded perspective view of the vacuum and recharging base illustrating one means by which the vacuum and recharging base may be keyed to one another.

With reference to FIG. 23, the interchangeable nature of the charging system of the present invention is illustrated. Specifically, several terminal block (1004) and key (i.e., 1006*a*, 1006*b*, 1006*c*, 1006*d*, and 1006*e*) combinations are illustrated as being interchangeable with the base 1000, while several receivers (1040*a*, 1040*b*, 1040*c*, 1040*d*, and 1040*e*) are illustrated in association with the vacuum 10*a*. Significantly, the injection molds for each of the key and the receiver employ exchangeable tooling segments that permit the molds to be readily converted so that they may be employed to form each of the various key configurations and receiver configurations. With reference to FIG. 24, five tooling segments 1050*a*, 1050*b*, 1050*c*, 1050*d* and 1050*e* are employed in conjunction with a base mold 1052 to produce each of the receiver combinations.

One especially significant aspect of providing various key and mating key combinations is the ability to provide a family of similar vacuums having different batteries (i.e., different voltages) yet which utilize as many common components as possible. In this regard, the various key and mating key combinations are employed to "key" a particular vacuum to a particular recharging base so as to prevent a vacuum from being coupled to a recharging base having a charging circuit that provides a charging voltage in excess of that which the batteries of the vacuum are designed to be charged.

Figure 25:
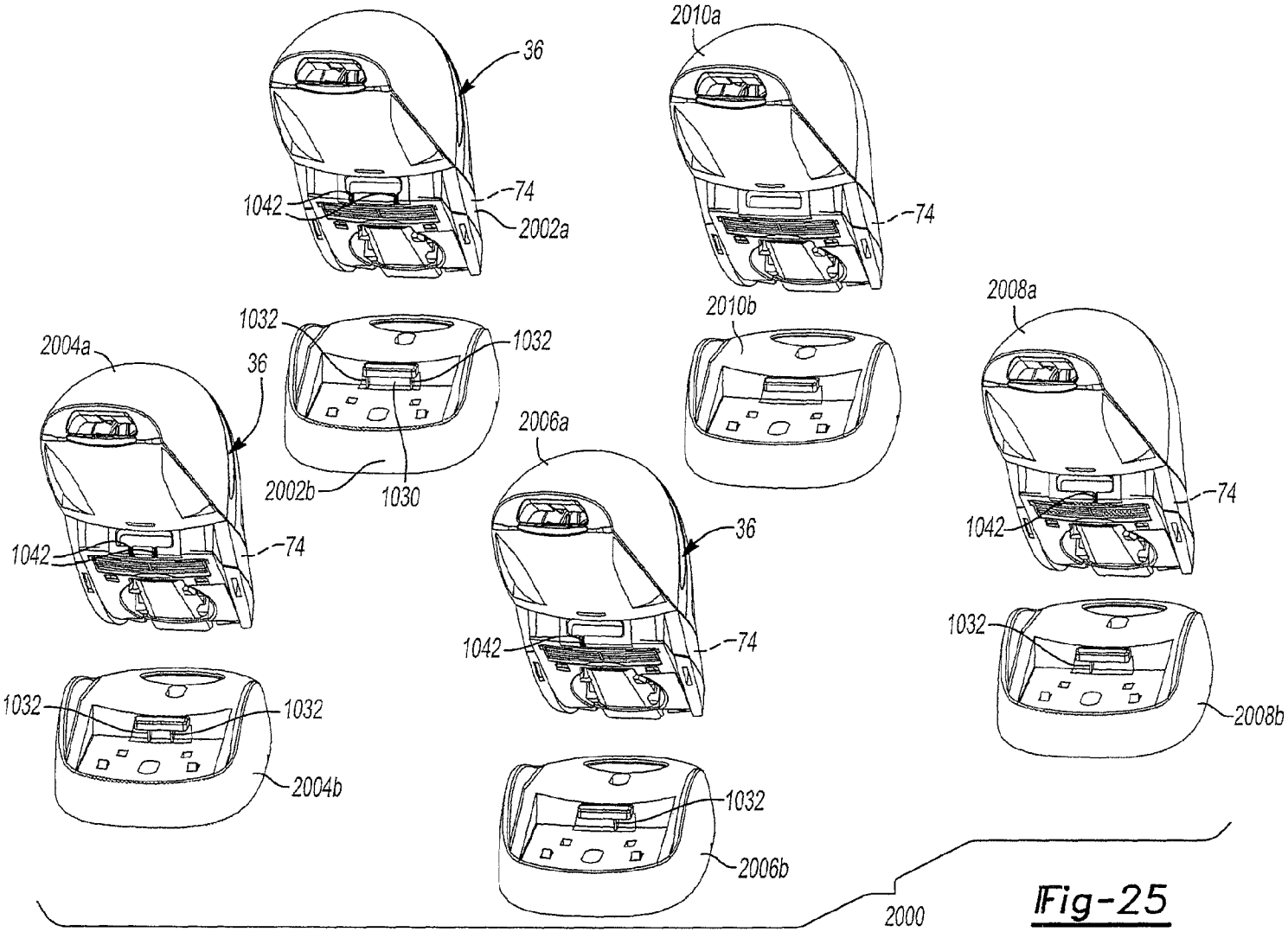
FIG. 25 is a perspective view of a family of vacuums and recharging bases constructed in accordance with the teachings of the present invention.

With reference to FIG. 25, a family of hand-held cordless vacuums is generally indicated by reference numeral 2000. The family of vacuums 2000 includes vacuums 2002*a*, 2004*a*, 2006*a*, 2008*a* and 2010*a*, which are associated with recharging bases 2002*b*, 2004*b*, 2006*b*, 2008*b* and 2010*b*, respectively. The vacuums 2002*a*, 2004*a* and 2006*a* are generally identical to vacuum 10*a* and differ from one another only in the design charging voltage of their respective battery packs 74. For example, the vacuum 2002*a* may have a design charging voltage of 14.4 volts, the vacuum 2004*a* may have a design charging voltage of 12 volts and the vacuum 2006*a* may have a design charging voltage of 9.6 volts. The vacuums 2008*a* and 2010*a* are similar to the vacuum 10*a* (FIG. 1) except that they lack a filter cleaning system 36 and may have design charging voltages of 7.2 volts and 4.8 volts, respectively. The recharging bases 2002*b*, 2004*b*, 2006*b*, 2008*b* and 2010*b* are generally identical to the recharging base 75 (FIG. 1) and differ from one another only in the charging voltage that they output.

As those skilled in the art will appreciate from this disclosure, the recharging bases (i.e., the keys) may be configured so that they will only engage one vacuum (i.e., mating key). However, it is permissible for a recharging base (i.e., key) to receive more than one type of vacuum (i.e., mating key) so long as the charging voltage provided by the recharging base will not exceed the design charging voltage of any vacuum that may be engaged thereto. In the particular example provided, any member of the family of vacuums 2000 may be engaged to the recharging base 2010*b*. Furthermore, the vacuum 2004*a* may also be engaged to the charging bases 2004*b*, 2006*b*, and 2008*b*.

Figure 26:
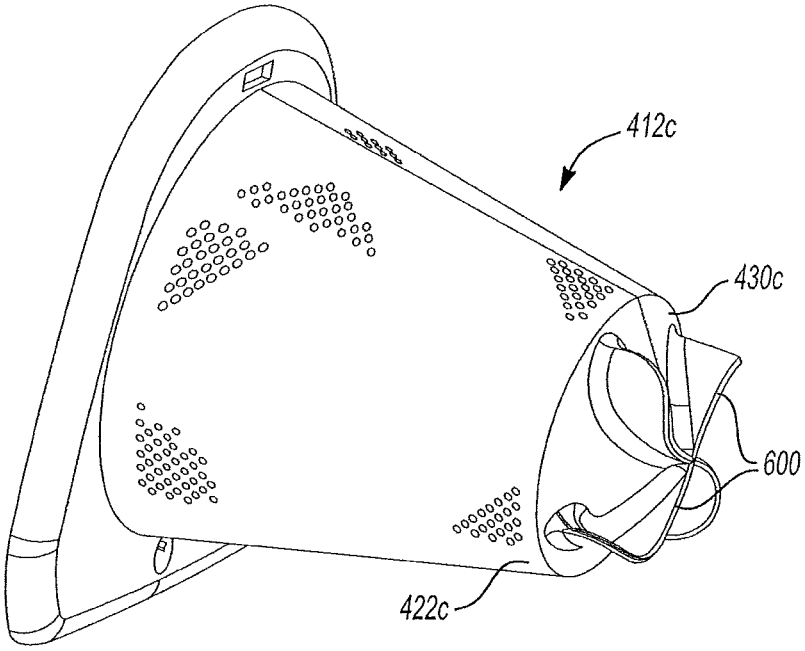
FIG. 26 is a perspective view of an alternately constructed prefilter.
Figure 27:
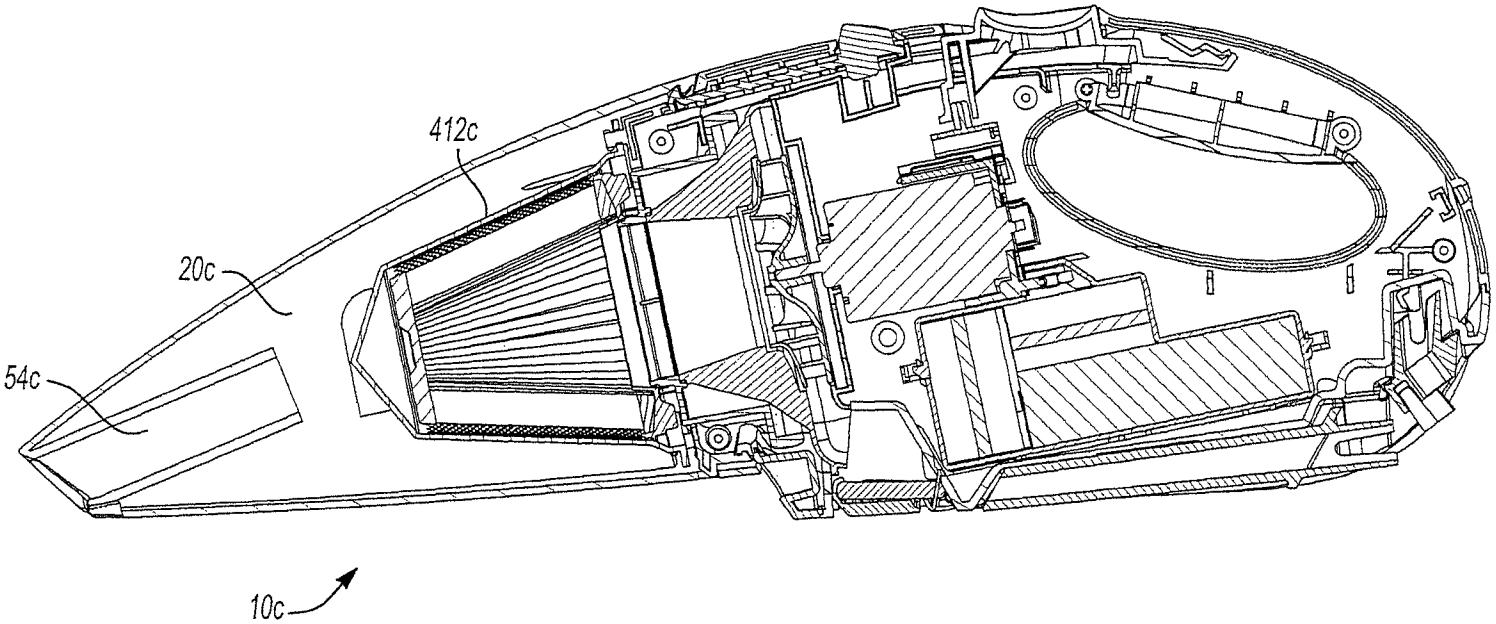
FIG. 27 is a longitudinal section view similar to that of FIG. 3 but illustrating the prefilter of FIG. 26.

While the vacuum 10*a* has been described thus far as employing an elbow to impart a swirling action to an incoming dirt and debris laden air flow and a manually rotatable cleaning wheel for use in dislodging particles of dirt and debris from a filter, those skilled in the art will appreciate that the invention, in its broader aspects, may be constructed somewhat differently. For example, the vacuum 10*c* may employ one or more vanes to swirl the incoming dirt and debris laden air flow as shown in FIGS. 26 and 27. In this example, the vacuum 10*c* is identical to the vacuum 10*a* described above, except that the elbow 22 (FIG. 3) is not employed and a prefilter 412*c* has been substituted for the prefilter 412. The prefilter 412*c* is substantially similar to the prefilter 412, except for the inclusion of a plurality of flow guiding vanes 600 on the front wall 430*c* of the prefilter body 422*c*. The flow guiding vanes 600 are disposed axially in-line with the inlet port 54*c* such that the axially directed incoming dirt and debris laden air flow is turned by the flow guiding vanes 600 outwardly toward the interior surface of the wall of the dirt cup 20*c*. As with the elbow 22, the flow guiding vanes 600 may be configured aggressively, wherein the entire flow is turned outwardly at the interior surface of the dirt cup 20*c*, or somewhat less aggressively, wherein the flow is turned outwardly but retains a portion of its original axial velocity.

Figure 28:
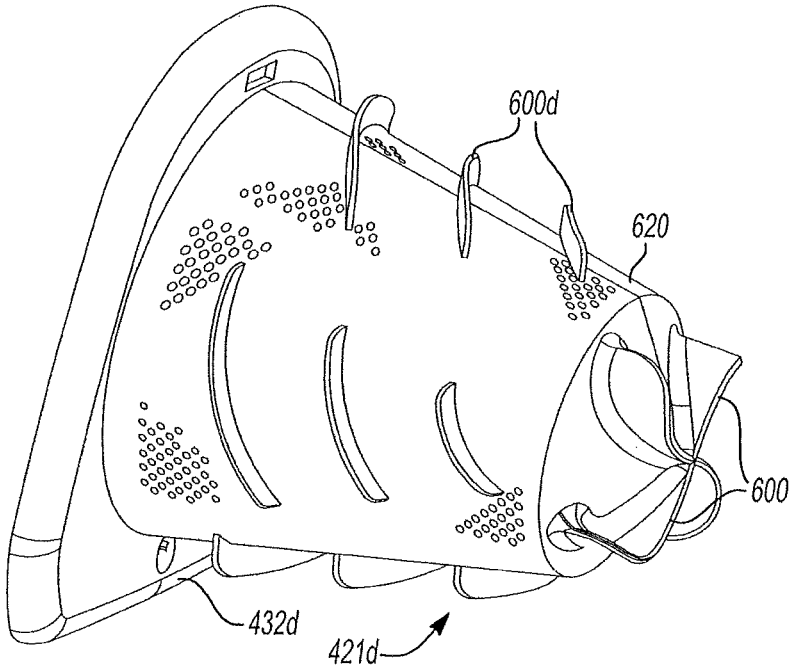
FIG. 28 is a perspective view of another alternately constructed prefilter.

As those of ordinary skill in the art will appreciate from this disclosure, vanes 600*d* for swirling the incoming dirt and debris laden air flow may be additionally or alternatively formed on another surface, such as the exterior surface 620 of the side wall 432*d* of the prefilter 412*d*, as illustrated in FIG. 28.

Figure 29:
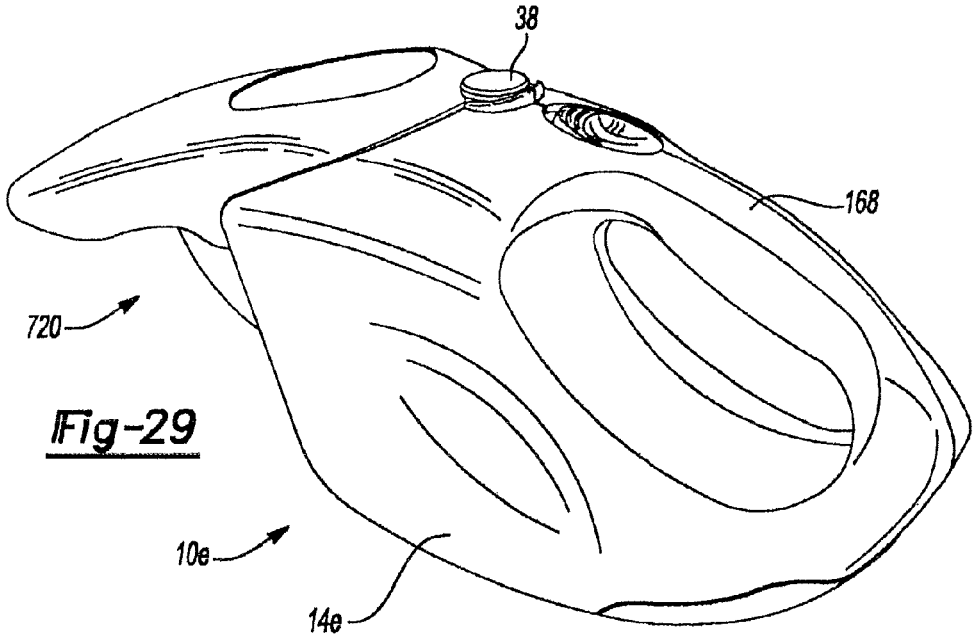
FIG. 29 is a perspective view of an alternately constructed vacuum.
Figure 30:
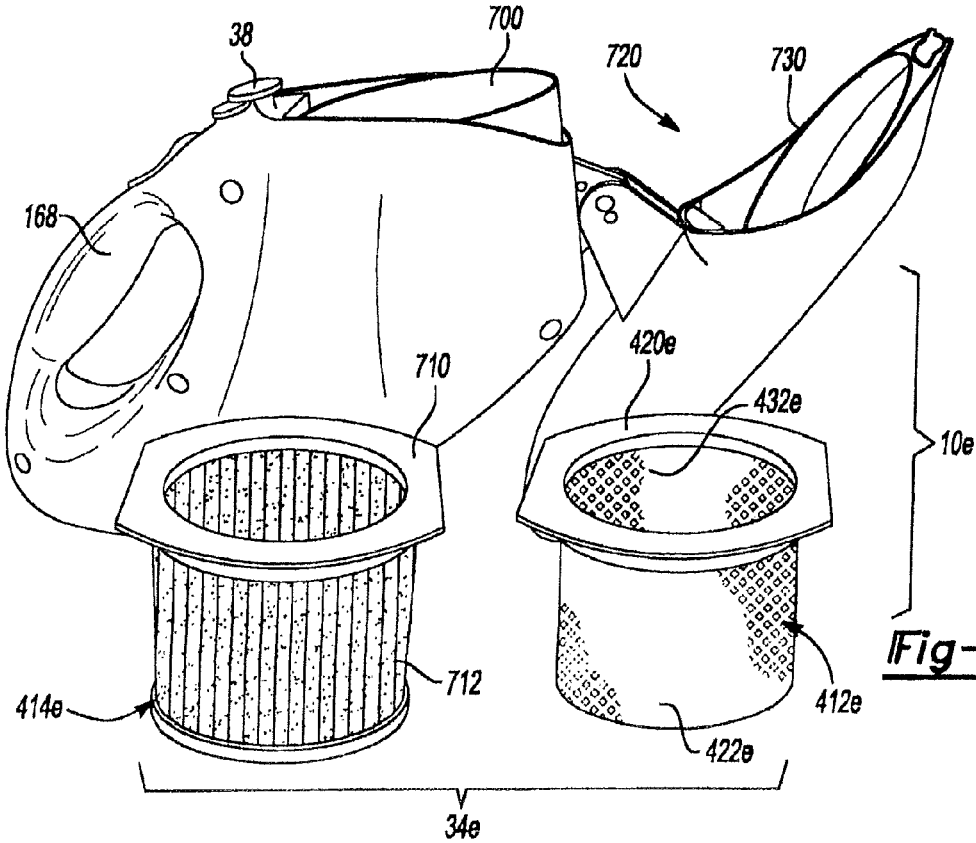
FIG. 30 is an exploded perspective view of the vacuum of FIG. 29.

Alternatively, the vacuum 10*e* may be configured as is shown in FIGS. 29 and 30. In this embodiment, the housing assembly 14*e* defines a filter recess 700 into which the filter system 34*e* is disposed. The filter system 34*e* includes a hat-shaped prefilter 412*e* and a hat-shaped primary filter 414*e*. The prefilter 412*e* includes a filter flange 420*e* and a prefilter body 422*e*, while the primary filter 414*e* includes a filter flange 710 and a filter body 712. A nozzle 720 is pivotally coupled to the housing assembly 14*e* and unlike the dirt cup 20 of FIG. 1, the nozzle 720 has no capacity for the storage of the dirt and debris that is drawn up by the vacuum 10*e*. Rather, coarse dirt and debris are retained in the prefilter 412*e* while finer dirt and debris which pass through the prefilter 412*e* are contained by the primary filter 414*e*. Pivoting of the nozzle 720 into the closed position causes the nozzle 720 to compress the filter flange 420*e* and filter flange 710 against one another such that a seal is formed between the nozzle 720 and the housing assembly 14*e*.

The nozzle 720 includes an outlet 730 that directs an incoming flow of dirt and debris laden air tangentially into the prefilter 412*e*, thereby generating a swirling effect that tends to reduce the accumulation of dirt and debris against the side wall 432*e* of the prefilter 412*e*. This configuration is highly advantageous in that it permits the user to not only perform vacuuming operations with a single hand, but also to empty the vacuum 10*e* of dirt and debris with a single hand. More specifically, the user need only access the latch release 38 to unlatch the nozzle 720 from the housing assembly 14*e* to permit the nozzle 720 to pivot into the open condition. A detent (not specifically shown) may be employed to retain the nozzle 720 in the open condition. The user need only grasp the handle 168 of the housing assembly 14*e* and overturn the vacuum 10*e* to empty the contents of the prefilter 412*e*.

Figure 31:
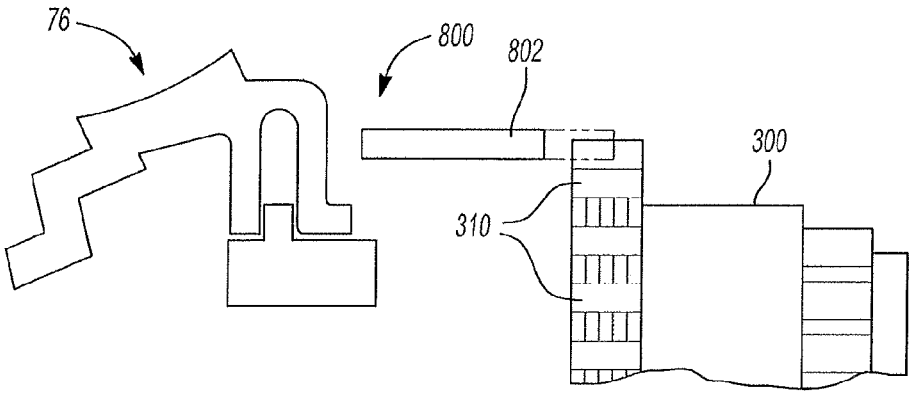
FIG. 31 is a partial longitudinal section view of another alternately constructed vacuum illustrating a lock-out device for inhibiting the operation of the cleaning wheel.
Figure 32:
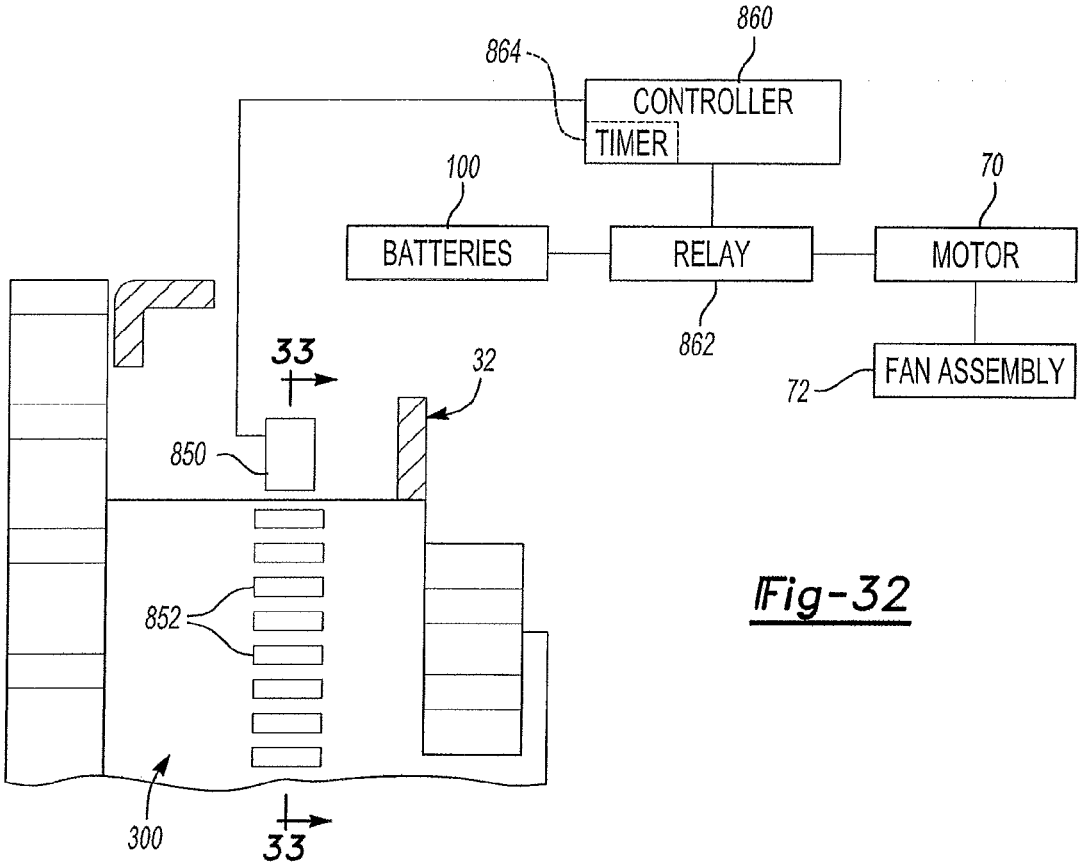
FIG. 32 is a schematic illustration of another alternately constructed vacuum illustrating an electronic lock-out device for inhibiting the operation of the motor when the cleaning wheel is rotated.
Figure 33:
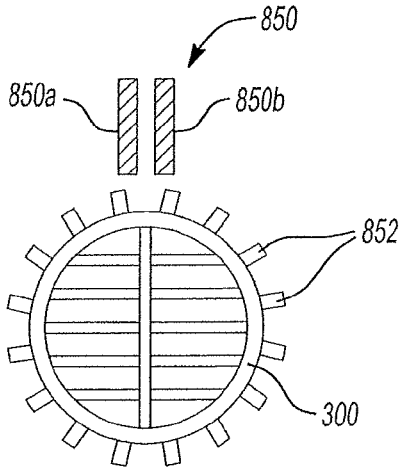
FIG. 33 is a sectional view taken along the line 33-33 of FIG. 32.

As is apparent from the discussion above, rotation of the cleaning wheel 300 when the impeller 90 is rotating renders the cleaning action relatively less effective (as compared to when the impeller 90 is not rotating) since dirt and debris that are dislodged when the cleaning wheel 300 is rotated tends to be immediately drawn back into the primary filter 414. Accordingly, it is within the scope of the present invention to include with the vacuum 10*a* a device that either locks the cleaning wheel 300 or electrically disables the fan assembly 72 when the cleaning wheel 300 is rotated. In FIG. 31, a lock-out device 800 is illustrated to be coupled to the power switch 76 for translation therewith. When the power switch 76 is activated, a lock-out member 802 translates into locking engagement with one of the circumferentially spaced apart recesses 310 in the gripping portion 302 of the cleaning wheel 300 to prevent the cleaning wheel 300 from being rotated. In FIG. 32, a sensor 850 is employed to detect the rotation of the cleaning wheel 300 relative to the housing 32 and generate a sensor signal in response thereto. In the particular example provided, the sensor 850 includes a pair of spaced apart contacts 850*a* and 850*b* which are normally not in contact with one another but which are urged into electrical contact with one another by actuating features 852 that are formed on the cleaning wheel 300. In response to receipt of the sensor signal, a controller 860 is employed to inhibit the flow of electricity from the batteries 100 to the motor 70 to thereby deactivate the fan assembly 72. In the example provided, the controller 860 employs a conventional relay 862 to inhibit the flow of electricity from the batteries 100 to the motor 70. In this latter embodiment, the controller 860 may include a timer 864 which maintains the motor 70 in a deactivated state for a predetermined amount of time after receipt of the sensor signal.

Figure 34:
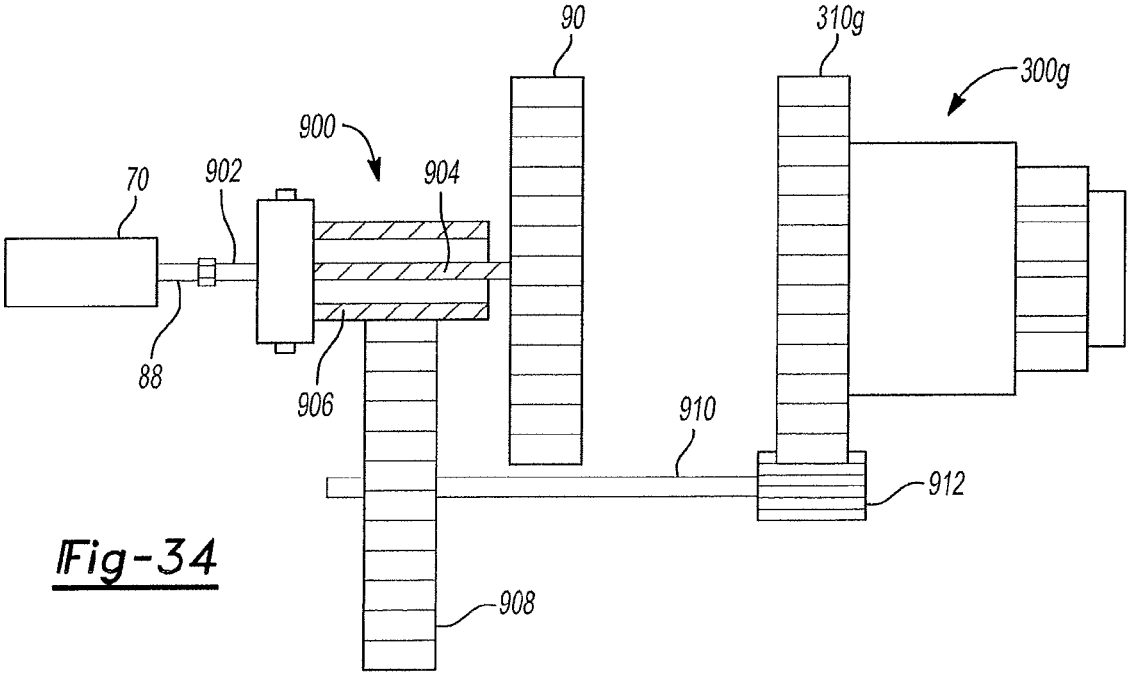
FIG. 34 is a schematic illustration of yet another alternately constructed vacuum illustrating a drive system for rotating the cleaning wheel under a source of power.
Figure 35:
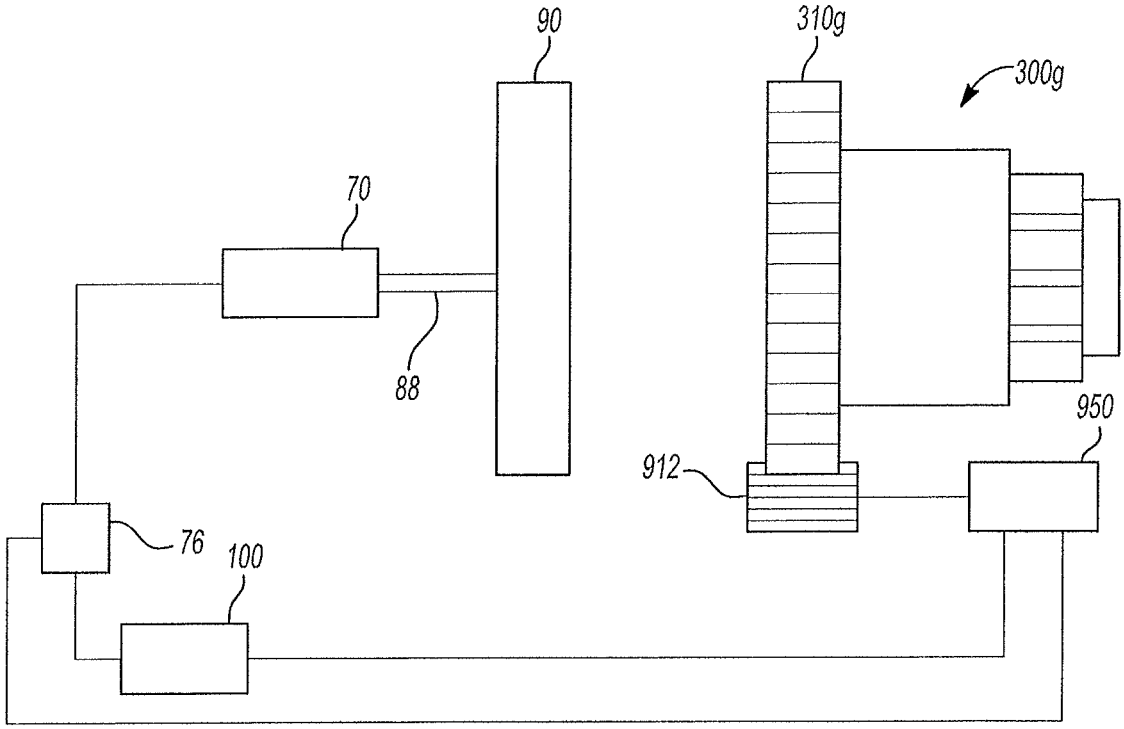
FIG. 35 is a schematic illustration of still another alternately constructed vacuum illustrating another drive system for rotating the cleaning wheel under a source of power.
Figure 36:
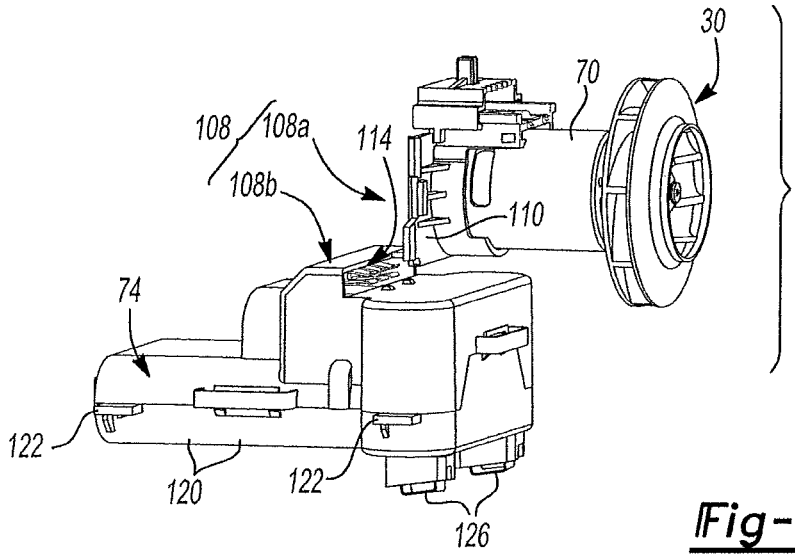
FIG. 36 is an exploded perspective view of a portion of the vacuum of FIG. 2 illustrating the battery pack and motor assembly in greater detail.
Figure 37:
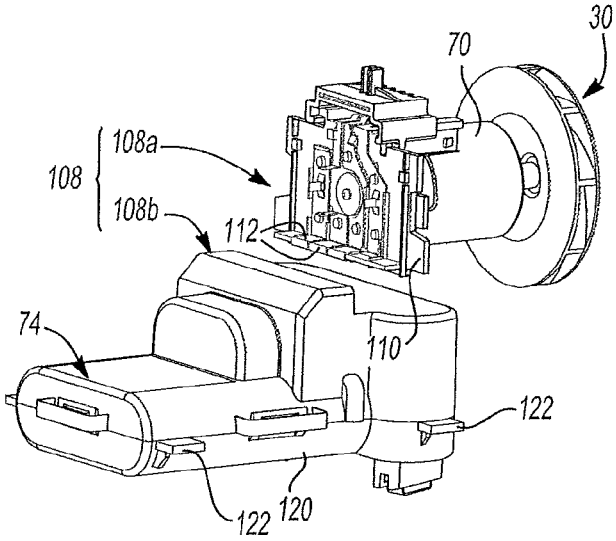
FIG. 37 is another exploded perspective view of the battery pack and motor assembly.
Figure 38:
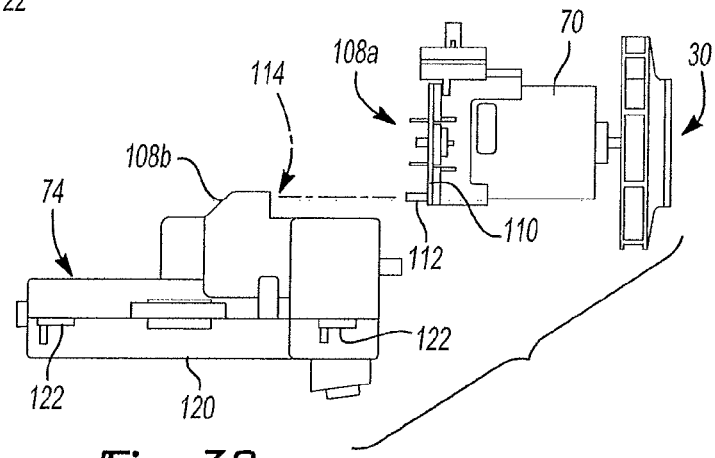
FIG. 38 is an exploded side elevation view of the battery pack and motor assembly.
Figure 39:
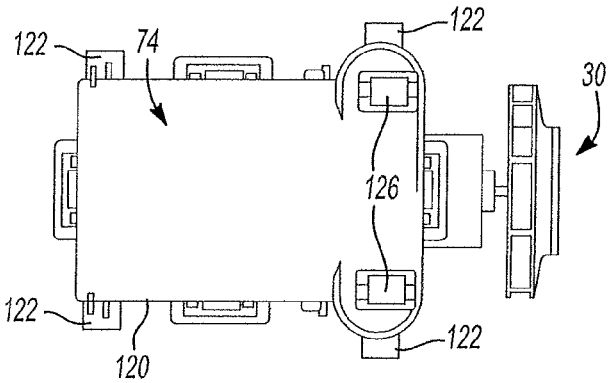
FIG. 39 is a bottom plan view of the battery pack as coupled to the motor assembly.

In the embodiments of FIGS. 34 and 35, the cleaning wheel is illustrated to be driven by a motor rather than manually operated. In FIG. 34, a clutch 900 having an input shaft 902, which is coupled to the output shaft 88 of the motor 70, a first output shaft 904, to which the impeller 90 is coupled for rotation therewith, and a second output shaft 906, which is concentric with the first output shaft 904, which is meshingly engaged with an idler gear 908. A shaft 910 couples an output pinion 912, which is meshingly engaged with teeth 310*g* formed on the cleaning wheel 300*g*, for rotation with the idler gear 908. The clutch 900 is normally operable in first condition, wherein rotary power is transmitted to the first output shaft 904 but not the second output shaft 906, and a second condition, wherein rotary power is transmitted to the second output shaft 906 but not the first output shaft 904. The clutch 900 is preferably electronically controlled, so that the user need only press a button to change the condition of the clutch 900 from the first condition to the second condition (such as by translating the power switch 76 (FIG. 3) in a direction opposite that which is normally employed to actuate the vacuum 10*a*). As noted above, the clutch 900 is normally operable in the first condition, so that when the button is released, the clutch 900 will revert to the first condition. In the embodiment of FIG. 35, a second motor 950 is employed to rotate the cleaning wheel 300.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A hand-held portable vacuum comprising:

a housing having a front end, a rear end, a top surface and a bottom surface;

a dirt cup having an inlet and defining a container for storage of dirt and debris therein, the dirt cup being removably attached to the front end of the housing and forming the entirety of a front portion of the vacuum and whose walls form a continuous surface with the housing;

a filter disposed inside the dirt cup, the filter being formed with a plurality of pleats and having an annular flange with driven tabs thereon;

a prefilter having a prefilter body that surrounds the filter and having ribs located on an interior surface of the prefilter;

a filter cleaning device having an actuation mechanism with drive tabs that directly engage driven tabs on the filter to rotate the filter within the prefilter so that the filter contacts the ribs to agitate the filter and dislodge accumulated dirt and debris from its pleats; and wherein the actuation mechanism is located within the housing, the housing having an opening adjacent the actuation mechanism so that a portion of the actuation mechanism is exposed to the exterior of the housing.

2. The hand-held vacuum of claim 1, wherein the prefilter body has an open end and the prefilter and filter are sealingly engaged to housing to close the open end.

3. The hand-held vacuum of claim 2, wherein the prefilter has a filter flange with an opening therein that engages a peg located on the housing to secure the prefilter to the housing.

4. The hand-held vacuum of claim 1, wherein the prefilter body has a truncated cone shape.

5. The hand-held vacuum of claim 1, wherein the filter has a truncated cone shape.

6. The hand-held vacuum of claim 1, wherein the actuation mechanism is a circular wheel.

7. A hand-held portable vacuum comprising:

a housing having a front end, a rear end, a top surface and a bottom surface;

a dirt cup having an inlet and defining a container for storage of dirt and debris therein, the dirt cup being removably attached to the front end of the housing and forming the entirety of a front portion of the vacuum and whose walls form a continuous surface with the housing;

a handle located on the top surface of the housing;

a motor located within the housing to the rear of the dirt cup;

a filter disposed inside the dirt cup, the filter being formed with a plurality of pleats and having an annular flange with driven tabs thereon;

a prefilter having a prefilter body that surrounds the filter and having ribs located on an interior surface of the prefilter;

a filter cleaning device having an actuation mechanism with drive tabs that directly engage driven tabs on the filter to rotate the filter within the prefilter so that the filter contacts the ribs to agitate the filter and dislodge accumulated dirt and debris from its pleats; and wherein the actuation mechanism is located within the housing, the housing having an opening adjacent the actuation mechanism so that a portion of the actuation mechanism is exposed to the exterior of the housing.

8. The hand-held vacuum of claim 7, wherein the prefilter body has an open end and the prefilter and filter are sealingly engaged to housing to close the open end.

9. The hand-held vacuum of claim 7, wherein the prefilter has a filter flange with an opening therein that engages a peg located on the housing to secure the prefilter to the housing.

10. The hand-held vacuum of claim 7, wherein the prefilter body has a truncated cone shape.

11. The hand-held vacuum of claim 7, wherein the filter has a truncated cone shape.

12. The hand-held vacuum of claim 7, wherein the actuation mechanism is a circular wheel.

* * * * *